US009795997B2

(12) United States Patent
Dearing et al.

(10) Patent No.: US 9,795,997 B2
(45) Date of Patent: Oct. 24, 2017

(54) SYSTEMS, METHODS AND DEVICES FOR ITEM PROCESSING

(71) Applicant: United States Postal Service, Washington, DC (US)

(72) Inventors: Stephen M. Dearing, Oak Hill, VA (US); Carla F. Sherry, Annandale, VA (US)

(73) Assignee: United States Postal Service, Washington, DC (US)

( * ) Notice: Subject to any disclaimer, the term of this patent is extended or adjusted under 35 U.S.C. 154(b) by 10 days.

(21) Appl. No.: 13/834,272

(22) Filed: Mar. 15, 2013

(65) Prior Publication Data

US 2014/0270356 A1 Sep. 18, 2014

(51) Int. Cl.
*B07C 7/00* (2006.01)

(52) U.S. Cl.
CPC ..... *B07C 7/005* (2013.01)

(58) Field of Classification Search
None
See application file for complete search history.

(56) References Cited

U.S. PATENT DOCUMENTS 3,419,128 A * 12/1968 Leonard ..... B65G 47/50 198/355
5,515,268 A * 5/1996 Yoda ..... A43D 1/02 702/1
5,754,938 A * 5/1998 Herz ..... G06Q 20/383 348/E7.056
5,870,203 A * 2/1999 Chiu ..... G01N 21/8903 250/559.46
5,917,925 A * 6/1999 Moore ..... G07B 17/00435 382/101
6,304,855 B1 * 10/2001 Burke ..... G06Q 10/087 235/383

(Continued)

FOREIGN PATENT DOCUMENTS

DE 10 2005 032533 A1 1/2007
EP 0 852 520 B1 8/1999

(Continued)

OTHER PUBLICATIONS

International Search Report and Written Opinion dated Jul. 15, 2014 for International Application No. PCT/US2014/024251, filed Mar. 12, 2014, which claims priority from captioned U.S. Appl. No. 13/834,272.

*Primary Examiner* — Tsung-Yin Tsai
(74) *Attorney, Agent, or Firm* — Knobbe Martens Olson & Bear LLP

(57) ABSTRACT

Methods, systems and devices for item processing. The systems can include a PASS module that can include features that receive inputs relating to an item for processing and provide those inputs to other components and/or modules of a PASS system and/or of another system. The PASS system can include a variety of modules, including the PASS module, and can collect information and/or inputs from the variety of modules of the PASS system and use that information in item processing. The methods of item processing can use the PASS system and the PASS module to perform a variety of functions including, for example, revenue protection, sorting of items, task management, sampling and data collection, redirecting if enroute items, and personnel management.

40 Claims, 19 Drawing Sheets

(56) References Cited

U.S. PATENT DOCUMENTS 6,325,283 B1 * 12/2001 Chu ..... G06F 8/65 235/375
6,866,194 B2 * 3/2005 Scheurer ..... G06Q 10/087 235/375
6,942,151 B2 * 9/2005 Ehrhart ..... G06K 7/10851 235/454
7,111,787 B2 * 9/2006 Ehrhart ..... G06K 7/10851 235/454
8,325,036 B1 * 12/2012 Fuhr ..... G06Q 10/087 340/5.92
8,818,875 B2 * 8/2014 Karnin ..... A47F 9/047 186/61
9,390,393 B2 * 7/2016 Felse ..... G06Q 10/083
2001/0034608 A1 10/2001 Gendreau
2003/0115162 A1 6/2003 Konick
2003/0212602 A1 * 11/2003 Schaller ..... G06Q 20/203 705/22
2005/0033648 A1 * 2/2005 Jin ..... G06Q 10/087 705/26.1
2006/0043188 A1 * 3/2006 Kricorissian ..... G06K 9/00993 235/462.08
2006/0050239 A1 3/2006 Hashimoto
2006/0106717 A1 * 5/2006 Randle ..... G06Q 20/04 705/45
2006/0159307 A1 7/2006 Anderson et al.
2006/0253406 A1 * 11/2006 Caillon ..... B07C 3/00 705/410
2007/0021883 A1 1/2007 Suggs, Sr.
2009/0008450 A1 1/2009 Ebert et al.
2009/0076918 A1 3/2009 Blanchet
2009/0087076 A1 4/2009 Jenrick et al.
2009/0114575 A1 5/2009 Carpenter et al.
2009/0303555 A1 * 12/2009 Barton ..... G03B 17/568 358/498
2010/0070388 A1 * 3/2010 Spindler ..... G06Q 10/087 705/28
2011/0046775 A1 * 2/2011 Bailey ..... B07C 3/00 700/224
2013/0179309 A1 * 7/2013 Heil ..... G06Q 10/087 705/28

FOREIGN PATENT DOCUMENTS

EP 1 027 785 A1 8/2000
EP 1 865 450 A2 12/2007
WO WO 98/21892 A1 5/1998

* cited by examiner

SYSTEMS, METHODS AND DEVICES FOR ITEM PROCESSING

BACKGROUND OF THE INVENTION

Field of the Invention

The application relates to systems, methods, and devices for item processing. More particularly, the application relates to systems for collecting data, systems for processing data, and methods of using the systems and collected data.

Description of the Related Art

Large numbers of items are processed in a variety of situations including, for example, by postal service providers, by delivery services, by manufacturers, and by a variety of other entities and organizations. The processing of a large number of items presents several challenges, particularly in cases in which the disposition of each item, and/or the action taken with respect to each item may be different. In certain circumstances, the determination of the disposition of each item can also be complicated by the fact that instructions for the proper disposition of the item may be located on the item. Thus, these instructions must be read and the disposition of an item must be determined from the read instructions. While scanning technology can be used in many situations to determine the item disposition when this information is included on an item, this process can be complicated in the event that items are of nonstandard size, in the event that the information is not uniformly placed on the item, or by a number of other variables.

While postal services have mechanized the process of sorting and disposing letters and flats, dealing with packages, and non-letter and non-flat items has proven to be more difficult. Typically, certain aspects of the sorting process have been done by hand by skilled individuals. While these methods can be effective, they present certain problems, particularly in the event that a trained individual is no longer available, in the event that the task for the trained individual changes, or in the event that the number of trained individuals required exceeds the number of trained individuals available.

Further, relying on trained individuals does not reap the benefit of many technological advances including, for example, in computing and other areas. By relying on trained individuals, the benefits of these new technologies are foregone and information relating to the disposition of items and item processing is not circulated throughout a system or network to be analyzed or used for other purposes. In light of these shortcomings, advances in systems, methods and devices for item processing are could be beneficial.

SUMMARY OF THE INVENTION

Some aspects described herein include a system for item processing comprising: a camera configured to capture an image of an item; a processor in communication with the camera, wherein the processor is configured to: determine if the captured image is acceptable; generate scan data from the captured image; and provide instructions relating to the disposition of the item based at least in part on the scan data; and an output in communication with the processor, the output configured to provide an instruction to a user relating to the disposition of the item.

In another aspect, a system for item processing comprises a first scan module configured to generate a first scan image of a first item and first scan data relating to the first scan image; a computing system comprising: a computing unit; and storage comprising a first database of disposition information and instructions; wherein the computing system is configured to: receive the first scan data; determine a disposition of the first item based at least in part on the first scan data; provide an instruction to the first scan module relating to the disposition of the first item; and wherein the first scan module receives the instruction for the disposition of the first item.

In another aspect, a method of item processing comprises capturing the image; determining if measured characteristics of the captured image are within a defined range for acceptance; generating scan data from the captured image; and providing instructions relating to the disposition of the item based at least in part on the scan data.

In another aspect, a method of item processing comprises receiving information relating to a scan of a label associated with an item; determining if the label has been associated with more than one item; determining a physical characteristic of the item; and determining if the received information associated with the label corresponds to the physical characteristic of the item.

The foregoing is a summary and thus contains, by necessity, simplifications, generalizations, and omissions of detail; consequently, those skilled in the art will appreciate that the summary is illustrative only and is not intended to be in any way limiting. Other aspects, features and advantages of the devices and/or processes and/or other subject matter described herein will become apparent in the teachings set forth herein. The summary is provided to introduce a selection of concepts in a simplified form that are further described below in the detailed description. This summary is not intended to identify key features or essential features of the claimed subject matter nor is it intended to be used as an aide in determining the scope of the claimed subject matter.

BRIEF DESCRIPTION OF THE DRAWINGS

The foregoing and other features of the disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with the additional specificity and detail through use of the accompanying drawings.

DETAILED DESCRIPTION OF EMBODIMENTS OF THE DISCLOSURE

Figure 1:
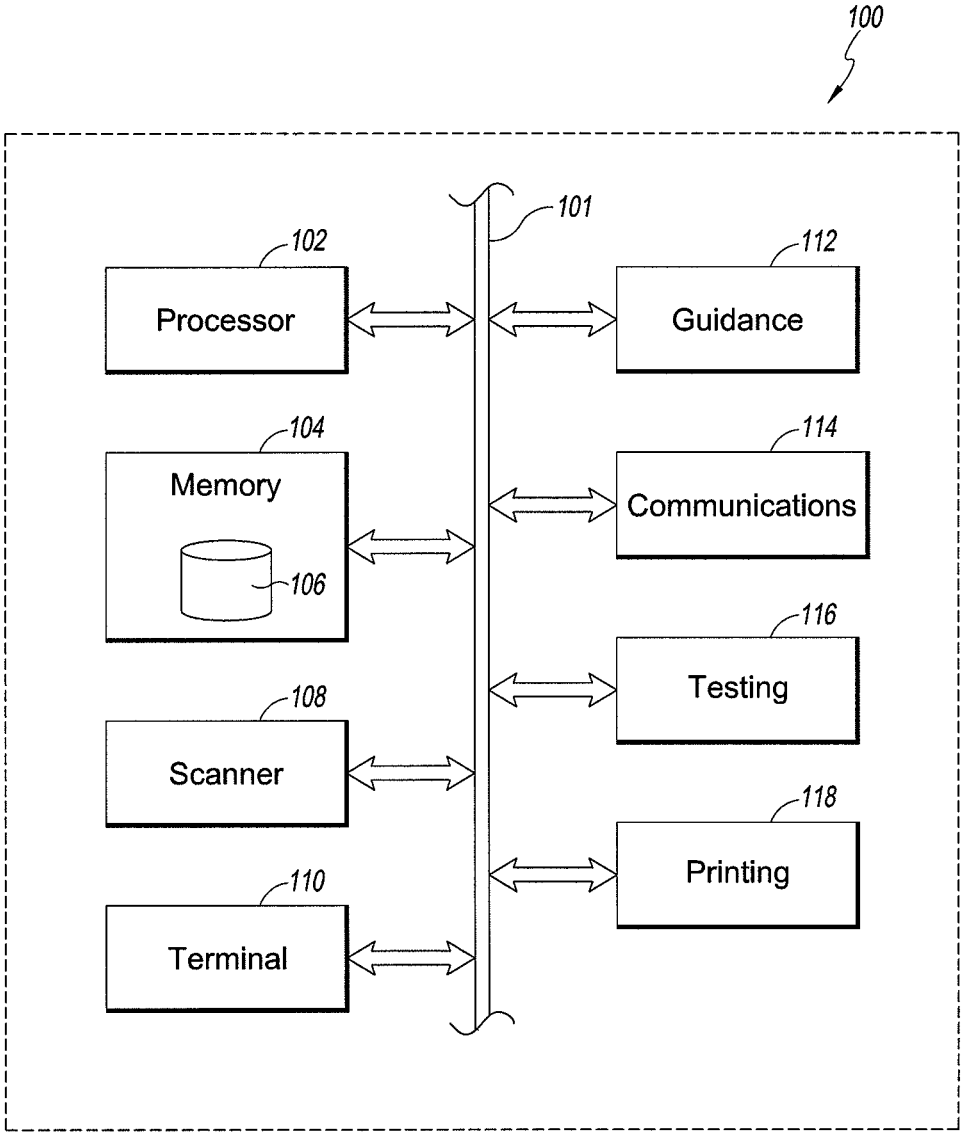
FIG. 1 is a schematic illustration of one embodiment of the system of a PASS module.

In the following detailed description, reference is made to the accompanying drawings, which form a part hereof. In the drawings, similar symbols typically identify similar components, unless context dictates otherwise. The illustrative embodiments described in the detailed description, drawings and claims are not meant to be limiting. Other embodiments may be utilized and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Embodiments described and disclosed herein relate generally to systems, methods, and devices for item processing, item scanning, and mailing of one or more items. For example, some embodiments relate to systems and devices that can be used to scan an item, and to process an item, to thereby facilitate mailing of one or more items.

Advantageously, the systems, methods, and devices described herein can provide a number of non-limiting benefits. For example, they can provide, benefits relating to the detection of fraud, minimization of payment discrepancies between paid-for services and provided services, employee/productivity management, sorting, routing, the performance of an action on an item and/or the management of tasks relating to an item, sampling of one or several items, altering the provided services for a received item, redirecting an item, and relating to a variety of other areas. These benefits can be provided, in part, by creating a system to receive and manage information relating to the items.

The systems, methods, and devices described herein provide for improved item processing. Some embodiments relate to a Passive Adaptive Scanning System ("PASS") module. The PASS module can include features and modules configured to gather data from an item and to transmit that data to a system. The PASS module is further configured to receive instructions from the system and to communicate those instructions to the user of the PASS module.

Some embodiments relate to a PASS system. In some embodiments, for example, the PASS system can include a PASS computing system that can be configured to receive inputs from the PASS module and to provide instructions to the PASS module in response to the received inputs. In some embodiments, for example, the PASS system can comprise other modules that can communicate with the PASS computing system. Advantageously, the PASS computing system collects information from the modules of the PASS system and can use this information to provide instructions and/or information to the PASS module.

Some embodiments relate to methods of using the PASS system for item processing. In some embodiments of these methods, for example, the PASS system can be used to assist in revenue protection, assist in taking action relating to an in-transit item, assist in sorting items into route groups and/or into delivery sequences, assist in collecting, tracking, and completing requested tasks, assist in sampling of items, assist in redirecting enroute items, and assist in employee productivity management. In these embodiments, the PASS computing system collects information from different modules of the PASS system and adds this information to one or several databases. The PASS computing system then, in response to a scanned event by one of the PASS modules, accesses the created database and the information stored therein, and uses that information as it is applicable to the scanned data generated by the PASS module to determine a desired outcome. In some embodiments an outcome of the PASS system can be any result from using the PASS system.

The PASS system can then provide instructions to the PASS module relating to the desired action. The PASS module can provide these instructions in multiple formats to a user who can, if necessary, execute these instructions to achieve the desired outcome.

The PASS Module

Some embodiments of systems, methods, and devices for item processing can include a PASS module. FIG. 1 depicts one embodiment of a PASS module 100. The PASS module 100 can comprise a variety of features and components, and can be configured to perform a variety of functions. In some embodiments, for example, the features and components of the PASS module 100 can be physically connected and/or in communication with each other. Thus, in some embodiments, the components of the PASS module 100 are in a single location and in other embodiments, the components of the PASS module 100 can be in multiple locations. In some embodiments in which the components of the PASS module are in different locations, these components can be in communication with each other.

The PASS module 100 can, in some embodiments, be configured to collect information from an item, this can be accomplished, for example, by scanning the item. In some embodiments, the item can be, for example, a package, a letter, or any other identifiable object. In some embodiments, the PASS module 100 can be further configured to receive inputs from a user. The PASS module 100 can communicate the information collected from the item and/or the inputs received from the user to other systems, and/or components of other systems. The PASS module 100 can be further configured to receive information, instructions, and/or other communications from the systems and/or modules of other systems, some of which will be disclosed below. The PASS module 100 can be configured to, in response to these received communications, provide outputs to the user.

In some embodiments, the components and modules of the PASS module 100 can be in communication via a communication feature 101. The communication feature 101 can comprise any feature capable of establishing a communicating connection between the features and modules of the PASS module 100 and can include, for example, a wired or wireless device, a bus, a communications network, or any other suitable communication feature.

As depicted in FIG. 1, the PASS module 100 can further comprise a processor 102. The processor 102 may comprise a single processor, or may be a component of a processing system implemented with one or more processors. The one or more processors 102 may be implemented with any combination of general purpose microprocessors, microcontrollers, digital signal processors (DSPs), field programmable gate array (FPGAs), programmable logic devices (PLDs), controllers, state machines, gated logic, discreet hardware components, dedicated hardware, finite state machines, or any other suitable entities that can perform calculations or other manipulations of information.

The processor 102 can be configured to receive inputs and signals from other components and/or modules of the PASS module 100. The processor can be further configured to perform operations with the inputs received from other components and/or modules of the PASS module 100. The processor 102 can execute stored instructions, and can direct the operation of the other components and/or modules of the PASS system 100.

As seen in FIG. 1, the processor 102 can communicate with other components and/or modules of the PASS module 100 via the communication feature 101. Thus, the processor 102 can send signals to and receive signals from other components and/or modules of the PASS module 100 via the communication feature 101.

As depicted in FIG. 1, the PASS module 100 can comprise a memory 104. In some embodiments, the memory 104 can be physically located at and/or in the PASS module 100, and in some embodiments, the memory 104 can be located remote from the PASS module 100.

The memory 104 can include, for example, RAM memory, flash memory, ROM memory, EPROM memory, EEPROM memory, registers, hard disk, a removable disk, a CD-ROM, or any other form of storage medium known in the art. The memory can include, for example, software, at least one software module, instructions, steps of an algorithm, or any other information. In some embodiments, the processor 102 can perform processes in accordance with instructions stored in the memory 104. These processes can include, for example, controlling features and/or components of the PASS module 100, requesting and/or receiving information from features and/or components of the PASS module 100 and/or the features and/or components of other systems and/or modules or components of other systems, transmitting instructions and/or control signals to other systems and/or features and/or components of the other systems, requesting information from the user, transmitting information to the user, processing information received from features and/or components of the PASS module 100, and/or from features and/or components of other connected systems, processing information received from the user, and/or any other desired processes.

In some embodiments, the memory 104 can comprise one or several databases. The databases can comprise an organized collection of digital data. The data stored in the databases can comprise any desired data, and can, in some embodiments, relate to functions of the PASS module 100 and/or any other connected or related systems.

In some embodiments, and as specifically depicted in FIG. 1, the memory 104 can comprise a database 106. In some embodiments, for example, the database 106 can be a scanned database. In some embodiments, the scanned database can comprise information collected by the PASS module 100. This information can include, for example, scanned images generated by the PASS module 100 and/or any other data affected by the PASS module 100. In some embodiments, for example, the scanned database can collect scanned images and/or other data collected by the PASS module 100 for a designated period of time. In some embodiments, the duration of the designated period of time can be limited by the amount of available memory, and by the usefulness of aged data. In some embodiments, for example, the scanned database can comprise information relating to all of the scans collected in, for example, the past six months, or any other desired timeframe.

In some embodiments, for example, the database 106 can comprise an input database. In some embodiments, for example, the input database can comprise information relating to one or more user inputs. In some embodiments, for example, these user inputs can relate to an item such as, for example, the physical properties of the item. Thus, in some embodiments in which a user may be requested to ascertain certain physical parameters of an item, the user may input these physical parameters into the PASS module 100. These input physical parameters can then be stored in the input database.

In some embodiments, for example, the database 106 can comprise a user database. In some embodiments, the user database can comprise information relating to users of the PASS module 100. This information can include, for example, times during which the user used the PASS module, number of items processed by a user, or any other user-related information.

The database 106 can, for example, comprise any other desired information, and is not limited to the above listed specific database embodiments.

As seen in FIG. 1, the memory 104 can communicate with the communication feature 101 of the PASS module 100. Thus, the processor 102 is in communicating connection with the memory 104, and can query the memory 104 for instructions and information. Similarly, due to the communicating connection of the memory 104 and the processor 102, the processor 102 can communicate information to the memory 104 and for storage in the memory.

The PASS module 100 can comprise, as depicted in FIG. 1, a scanner module 108. The scanner module 108 can be configured to collect information from an item. In some embodiments, for example, the scanner module 108 can be configured to read text and/or text strings located on the item, computer-readable code located on the item such as, for example, a barcode including a linear bar code, a 2D barcode, a QR code, an intelligent mail barcode, and/or any other desired computer-readable code, and/or collect any other desired format of information on the item. In some embodiments, the scanner module 108 can be configured to generate image data of the item. Thus, for example, in some embodiments, the scanner module 108 can generate and/or collect one or several still images of the item and/or one or several films of the item.

In some embodiments in which the scanner module 108 generates image data of the item, the scanner module 108 can be configured to have sufficient resolution so as to allow use of the collected image data to generate scan data relating to information on the item. Thus, in some embodiments, the scanner module 108 can include features configured to achieve the desired resolution of the images. In some embodiments, for example, the scanner module can comprise one or several lights. In some embodiments, these lights can be configured to illuminate the item of which image data is being generated. In some embodiments, for example, these lights can be configured to achieve a minimum level of lighting of the item. In some embodiments, for example, these lights can be configured to achieve a minimum level of lighting of a certain and/or specific frequency. In some embodiments, for example, these lights can comprise one or several light bulbs, one or several LEDs, and/or one or several of any other light-generating feature.

In some embodiments, for example, the scanner module 108 can comprise features configured to facilitate use of the scanner module 108. In some embodiments, these features can be configured to facilitate the generation of accurate scan data, and/or the collection of the desired image data. In some embodiments, for example, these features can include targeting features configured to assist the user in aligning the item with the viewing area of the scanner module 108, in other words, the area viewed by the scanner module 108. In some embodiments, for example, these targeting features can define the boundaries of the area for which the scanner module 108 generates image data. In some embodiments, these targeting features can indicate the center of the area for which the scanner module 108 generates image data. In one embodiment, for example, these targeting features can comprise, a crosshair, a grid, an "X", and/or any other desired feature configured to facilitate targeting. In one specific embodiment, the targeting feature can comprise a projected crosshair and/or projected grid. Advantageously, this projected crosshair and/or projected grid can be projected onto an item placed in the viewing area, and can thus be viewable on an item placed in the viewing area to thereby allow the proper positioning of the item.

In some embodiments, this targeting feature can indicate a target zone, or a horizontal area normal to the direction in which the scanner module 108 is pointed. In some embodiments, for example, the target zone can be associated with a target area. In some embodiments, for example, the target area comprises the range of distances from the scanner module 108 in which the item can be placed and a successful image data can be generated from the item. In some embodiments, the target zone and target area define a third area in which successful image data can be generated.

In some embodiments, the scanner module 108 can be, for example, controlled by a processor. In some embodiments, the processor controlling the scanner module 108 can comprise the processor 102. In some embodiments, for example, the processor controlling the scanner module 108 can comprise a different processor than the processor 102 discussed above. In some embodiments, the scanner processor can be in communication with a scanning memory separate from memory 104, and can operate in accordance with instructions stored in the scanning memory.

In some embodiments, the instructions stored in the scanning memory can include, for example, instructions to determine when an item is in the target zone and in the target area, instructions to determine when a desired portion of the item such as, for example, a specified label type or one of several label types, is within a certain region of the target zone and/or target area. In some embodiments, for example, these instructions can include directing the scanner 108 to capture images when the item is detected in the target zone and/or target area and when the desired portion of the item, such as the label and/or several labels, is within the certain specified region of the target zone and/or target area.

In some embodiments, the scanner module 108 can be housed in a single housing, and in other embodiments, the scanner module 108 can be divided up into multiple separate housings. Advantageously, dividing the scanner module 108 into separate housings can facilitate using the scanner module 108 in certain applications.

The PASS module 100 can include a terminal 110, as depicted in FIG. 1. The terminal can be configured to allow a user to interact with the PASS module 100. In some embodiments, for example, the terminal 110 can provide outputs to the user and/or receive inputs from the user. As seen in FIG. 1, the terminal 110 can be in communicating connection with the other components and/or modules of the PASS module 100 via the communication feature 101. Thus, the terminal 110 can send information and/or signals to and receive information and/or signals from the other components and/or modules of the PASS module 100.

The terminal 110 can comprise a variety of features and/or components. In some embodiments, the terminal 110 can comprise any device and/or system capable of providing outputs to a user and receiving inputs from a user. In some embodiments, the terminal 110 can include features to facilitate the providing of outputs to the user and receiving inputs from a user including, for example, a screen, a keypad, a touch screen, a speaker and a microphone, and/or any other features capable of providing output to a user and receiving inputs from a user.

In some embodiments, the terminal 110 can include a processor and memory separate from the processor 102 and memory 104 of the PASS module 100, and in some embodiments, the terminal 110 can use the processor 102 and memory 104 of the PASS module 100.

As depicted in FIG. 1, the PASS module 100 can further include a guidance module 112. In some embodiments, the guidance module 112 can be configured to provide simple outputs to direct the actions of the user. In some embodiments, these outputs can comprise audio and/or visual information indicating a desired action. In some embodiments, for example, these audio and/or visual outputs can indicate the success of a scan operation, how to sort an item, for the user to use the terminal 110 to provide further information relating to the item, for the user to perform an action relating to the item, and/or any other desired instruction.

In some embodiments, the guidance module 112 can comprise one or several components capable of providing these instructions and/or outputs to instruct the user. In one embodiment, the guidance module 112 can include, for example, an indicator of scan success. In some embodiments, this indicator of scan success can comprise one or several lights located in the scanner module 108. In one particular embodiment, these lights located in the scanner module 108 can be configured to project colored light onto the item after the scanning operation. In some embodiments, for example, the color of light projected onto the item after the scanning action can vary based on whether the scanning operation was successful. Thus, in some embodiments, a green light can be projected onto the item after a successful scanning operation, and a red light can be projected onto the item after an unsuccessful scanning operation.

In some embodiments, the guidance module 112 can comprise an audible indicator of scanning success. In some embodiments, this can include a speaker located on the PASS module 100 that provides audible signals indicating whether a scanning operation was successful. In some embodiments, these audible signals can be distinguishable to allow a user to determine whether a scan operation was successful.

In some embodiments, the guidance module 112 can comprise features and/or components configured to indicate an action that the user should take. In some embodiments, these actions can include, for example, placing the item in a pre-designated area, removing the item from circulation, ascertaining the physical properties of the item, sampling the item, seizing the item, verifying payment information of the item, and/or any other desired action. In some embodiments, these features can include, for example, lights such as the lighting of an area in which an item should be placed, a display capable of indicating a next action and/or displaying text and/or text strings, speakers configured to provide audible indications of a next action, and/or any other desired feature. A person of skill in the art will recognize that a variety of features can be used to provide outputs to a user to instruct the user to take a desired action, and that the present application is not limited to the above-specified features and components.

The PASS module 100 can, in some embodiments, comprise a communications module 114. The communications module 114 can be in communication with the communications feature 101 and thereby in communicating connection with all of the other features and/or components of the PASS module 100. In some embodiments, the communications module 114 can be configured to communicate with other PASS modules 100 and/or other systems and/or components of other systems. In some embodiments, the communications module 114 can be configured for wired and/or wireless communication, and can be configured to request information and receive inputs from other systems and/or other components of other systems. In some embodiments, for example, the communications module 114 can receive instructions from the processor 102 directing the operation of the communications module 114. In some embodiments, for example, these instructions from the processor 102 can be in accordance with stored instructions found in the memory 104.

In some embodiments, for example, the PASS module 100 can further comprise a testing module 116. In some embodiments, the testing module 116 can be configured to facilitate ascertaining information related to a scanned item. In some embodiments, this information related to a scanned item can comprise, for example, physical information relating to the scanned item such as the dimensions of the scanned item, the weight of the scanned item, the type of services requested for the scanned item, the nature and/or contents of the scanned item, and/or any other desired physical information relating to the scanned item.

The testing module 116 can include features and components to facilitate the gathering of information relating to the scanned item. In some embodiments, these features and/or components can include sensors capable of detecting the desired physical properties relating to the scanned item. Thus, in some embodiments, the testing module 116 can comprise, for example, a scale, and/or sensors capable of determining the other parameters of the scanned item. In some embodiments, the testing module 116 can include items configured to assist in determining the dimensions of a scanned item such as, for example, a measuring tape, a measuring stick and/or yardstick or ruler, and/or any other user-operated measuring device. In some embodiments in which the user uses a measuring device to determine the dimensions of the scanned item, the user can use the terminal 110 to provide inputs to the PASS module 100 relating to the dimensions of the scanned item.

In some embodiments, the testing module 116 can comprise further sensors and/or components to ascertain other information relating to the scanned item. These other sensors and/or components can include, for example, metal detectors, x-ray machines, sensors configured to detect explosives, sensors configured to detect drugs and/or other illegal contraband such as, for example, prohibited food products, prohibited chemicals, prohibited liquids, and/or any other prohibited item.

In some embodiments, the testing module 116 can cooperate with the processor 102 to verify the correctness and/or compliance of a tested item. In some embodiments, for example, the testing module 116 can provide information related to the scanned item to the processor 102. In the event that the information from the testing module 116 relates to physical properties of the scanned item such as, for example, the item weight and/or item dimensions, the processor 102 can compare this information from the testing module 116 with information contained in the item label to verify the correctness of the item label information.

As seen in FIG. 1, some embodiments of the PASS module 100 can include a printing module 100. The printing module 118 can be configured to create labeling for applying to the item. In some embodiments, for example, this labeling can be updated destination labeling, updated labeling requesting services related to the scanned item, updated labeling relating to the cost of the services provided for the scanned item, and/or any other desired additional labeling. In some embodiments, the printing module 118 can communicate with the communications feature 101 and thereby communicate with the other components and/or modules of the PASS module 100. In some embodiments, specifically, the printing module 118 can provide information to the processor 102 and receive instructions from the processor 102.

In some embodiments, the printing module 118 can comprise one or more printers that can be configured to print the additional labeling for applying to the item.

A person of skill in the art will recognize that a PASS module 100 can comprise more or fewer components and/or modules than those outlined herein and that a PASS module 100 can perform more or fewer functions than those outlined herein.

Figure 2:
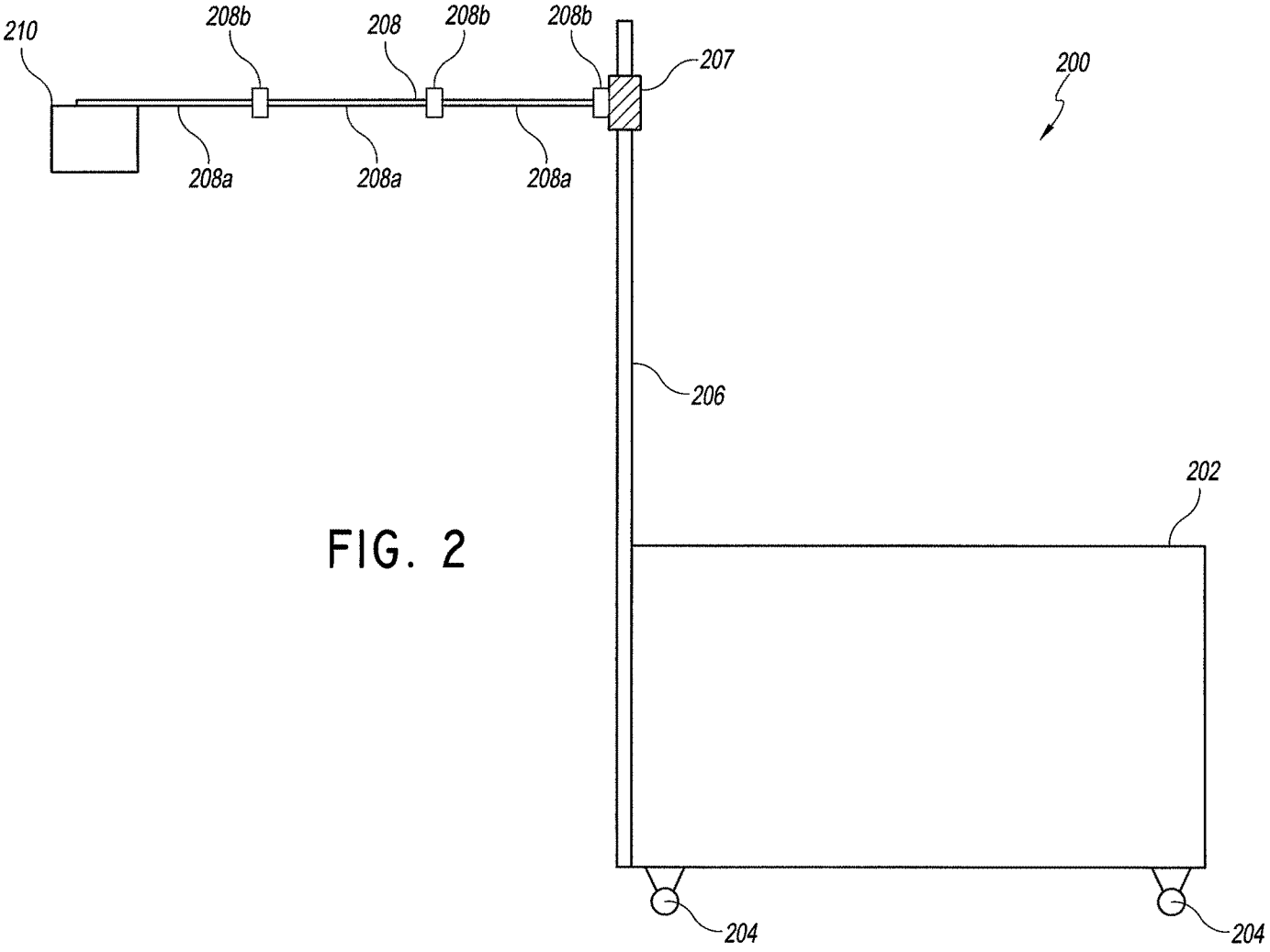
FIG. 2 is a side view of one embodiment of a PASS cart.

Some embodiments of the PASS module 100 can be associated with different features configured to facilitate use of the PASS module 100. FIG. 2 depicts one embodiment of physical features associated with a PASS module 100 to facilitate the use of the PASS module 100. Specifically, FIG. 2 is a side view depicting a PASS cart 200. A PASS cart can be configured to hold all the components of the PASS module 100. In some embodiments, the PASS cart 200 can be configured to be mobile. In some embodiments, the PASS cart 200 can be configured to be fixed in one position. The PASS cart 200 can comprise a variety of shapes and sizes and can have a variety of features and dimensions.

The PASS cart 200 depicted in FIG. 2 comprises a body 202 that can comprise a variety of shapes and sizes and features. In some embodiments, for example, the body 202 can be configured to hold and/or support the components and/or modules of the PASS module 100. In some embodiments, the body 202 can include shelves, cabinets, drawers, and other storage features to facilitate in storing the modules and/or components of the PASS module 100. In some embodiments, the body 202 can be sized and dimensioned to allow it to withstand the demands of holding the PASS module components. In some embodiments, the body 202 can be configured to resist tipping when it is loaded with the modules of the PASS module 100. In some embodiments in which the PASS cart 200 is configured to be mobile, the body 202 can be connected to wheels 204.

As further depicted in FIG. 2, the PASS cart 200 can comprise a vertical track 206. In some embodiments, the vertical track 206 can be connected at a first end to the body 202 of the PASS cart 200. In some embodiments, the second end of the vertical track 206 can extend vertically above the body 202 of the PASS cart 200. The vertical track 206 can be configured to allow the differential vertical positioning of sliding member 207 along the vertical track 206. Thus, in some embodiments, the sliding member 207 may be positioned in close proximity to the wheel 204 of the body 202, and in some embodiments, the sliding member 207 may be positioned proximate to the second end of the vertical track 206.

In some embodiments, the vertical track 206 and the sliding member 207 can be configured to withstand loads associated with an arm 208 connected at a first end to the sliding member 207 and connected at a second end to a camera 210. Thus, the size, dimensions, and materials of both vertical track 206 and the sliding member 207 can vary based on the properties of the arm 208 and the camera 210, such as, for example, the weight of the arm 208 and the camera 210, the length of the arm 208, and the range of positions relative to the vertical track 206 in which the arm 208 can be positioned.

FIG. 2 depicts one embodiment of an arm 208 included in the PASS cart. As seen in FIG. 2, the arm 208 comprises a plurality of rigid members 208*a* connected by a plurality of joints 208*b*. The joints 208*b* can be configured to allow the angular displacement of the rigid members 208*a* relative to each other. In some embodiments, this displacement can be limited to a plane that is perpendicular to the longitudinal axis of the vertical track 206, and can comprise, a horizontal plane.

In some embodiments, the configuration of the arm 208 with rigid members 208*a* joined by joints 208*b* allows the arm 208 to articulate and be moved through a variety of positions and distances from the vertical track 206. In some embodiments, such as the embodiment of the PASS cart 200 depicted in FIG. 2, the joints 208*b* of the arm 208 are configured to allow movement in a horizontal plane, which plane is perpendicular to the longitudinal axis of movement of the vertical track 206. Thus, the combination of vertical track 206 and the articulating ability of the arm 208 via the joints 208*b* can allow positioning of the camera 210, which is affixed at the second end of the arm 208, by, for example, one or several bolts, in a variety of vertical as well as horizontal positions.

As depicted in FIG. 2, the PASS cart 200 can comprise the camera 210 that can be located at the second end of the arm 208. The camera can be a component of the scanner module 108. In some embodiments, the camera 210 can be a digital camera, a scanner, a barcode reader, or any other device capable of retrieving information from an item. In some specific embodiments, the camera 210 can comprise a high-resolution, high-speed camera 210 capable of retrieving a variety of information types from an item including, for example, information in computer-readable codes such as, for example, barcodes, information contained in text and/or text strings such as, for example, a written name and or written address, information contained in the signaling device such as, for example, an RFID tag, or any other desired type of information.

In some embodiments, due to the positioning of the camera 210 at the second end of the arm 208, the camera 210 can be configured to minimize its weight to thereby minimize the moment applied to the arm 208, to the vertical track 206, to the sliding member 207, and to the body 202. In some embodiments, these weight minimizations can be achieved by dividing the camera 210 into an optical component located at the second end of the arm 208 and a processing component located in or on the body 202. In some embodiments, the optical component of the camera 210 and the processing component of the camera 210 can be in communication with each other to transmit information collected by the optical component to the processing component of the camera 210. In some embodiments, to further offset problems arising from the positioning of the camera 210 at the second end of the arm 208, the body 202 can include features to increase its weight, to lower its center of gravity, and to prevent instability in the body 202 and the tipping of the body. In some embodiments, these features can include, for example, a steel plate located at the bottom of the body 202.

A person of skill in the art will recognize that a PASS cart 200 can comprise more or fewer features than those outlined and discussed herein.

Figure 2A:
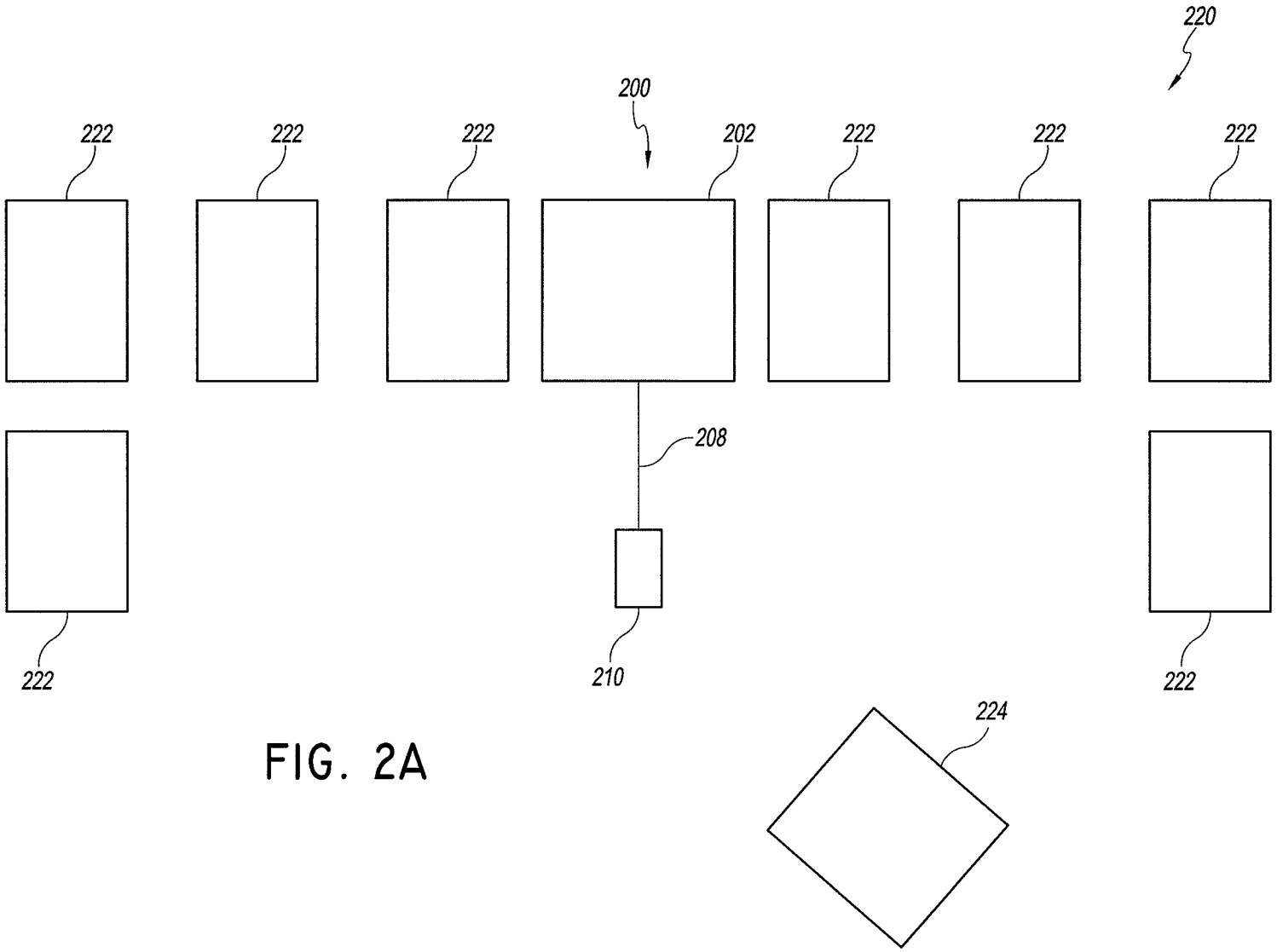
FIG. 2*a* is a schematic illustration of one embodiment of a layout using a PASS cart.

In some embodiments, the PASS cart 200 can be used with other features and components to facilitate performing an operation on an item and/or in processing an item. FIG. 2A depicts one embodiment of a PASS cart 200 in use with other components to facilitate item processing. Specifically, FIG. 2A depicts one embodiment of a bullpen 220. A bullpen 220 can comprise, for example, a PASS cart 200 having a body 202, an arm 208, and a camera 210 located at the second end of the arm 208. In such a configuration, the PASS cart 200 can be used to collect information from an item, to assist in performing an action on an item, and/or to provide instructions as to an action to be taken in regards to an item.

In some embodiments, the PASS cart 200 can provide instructions to place the item for which information has been collected by the PASS cart 200 in a receptacle 222. In some embodiments of the bullpen 220, and as shown in FIG. 2A, a plurality of receptacles 222 can be arranged around a PASS cart 200. In some embodiments, for example, each of these receptacles 222 can correspond to a different action, outcome, and/or instruction indicated by the PASS cart 200. Thus, in some embodiments, the PASS cart 200 will provide an indication that an item, for which information has been collected by the PASS cart 200, should be placed in a specified one of the receptacles 220, and the PASS cart 200 can provide instructions that another item should be placed in a different specified receptacle 222. In some embodiments, for example, these different receptacles 222 can correspond to different sortations of the items, to different actions to be performed on the items, to different types of items, and/or any other desired sortation, outcome, and/or action.

The receptacles 222 can comprise a variety of items and can comprise a variety of shapes and sizes. In some embodiments, a receptacle 222 can be any feature and/or thing capable of receiving an item. Thus, a receptacle 222 could be a designated area, a box, a hamper, a pallet, a crate, a conveyor belt, and/or any other designated device, feature or location.

In some embodiments, the receptacle 222 can comprise features configured to assist the user in placing the item in the proper receptacle 222. In some embodiments, for example, these features can include an indicator that provides an audio and/or visual signal indicating in which of the receptacles 222 an item should be placed. In some embodiments, this feature and/or component of the receptacle 222 can be in communicating connection with the PASS module 100. Thus, in some embodiments, this feature of the receptacle 222 can be triggered by the PASS module 100 in response to determining a receptacle 222 for receiving the item.

FIG. 2A also shows a source 224. In some embodiments, the source 224 can comprise any feature capable of bringing items to the bullpen 220. In some embodiments, the source 224 can comprise a hamper, a pallet, a conveyor, a cart, a wagon, and/or any other similar feature or device.

FIG. 2A depicts one layout of a bullpen 220 in which the PASS cart 200 is located in the center of a U-shaped arrangement of a plurality of receptacles 222. Advantageously, such an arrangement allows easy access to the PASS cart 200 as well as to each of the receptacles 222. A person of skill in the art will recognize, however, that more or fewer receptacles 222 could be used in a bullpen 220, and that more or fewer sources 224 and PASS carts 200 could be used in a bullpen. A person of skill in the art will further recognize that the present disclosure is not limited to this specific embodiment of a bullpen 220, but rather covers the concept of using a bullpen 220 in connection with a PASS cart 200.

Figure 2B:
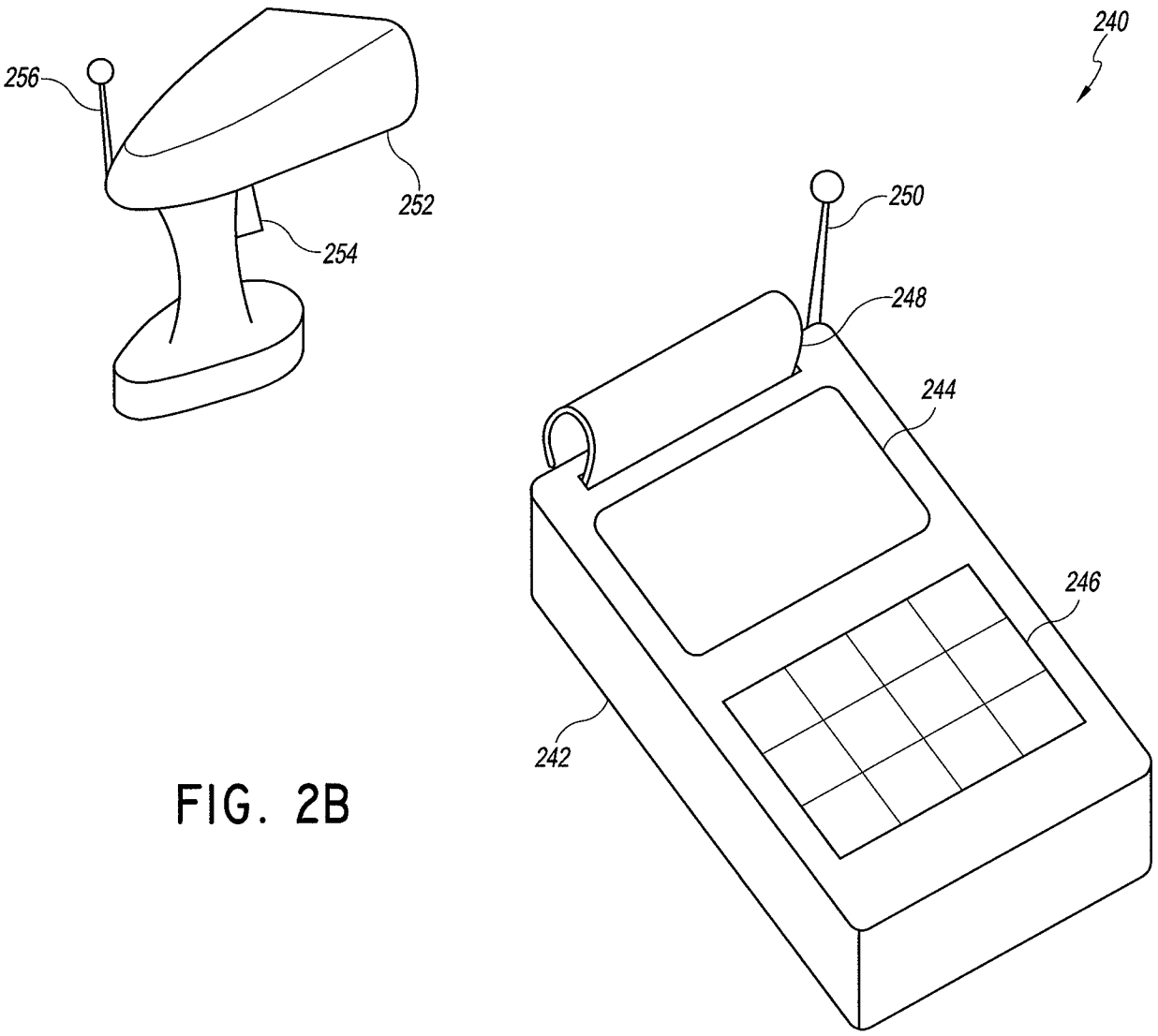
FIG. 2*b* is a perspective view of one embodiment of handheld PASS devices.

In some embodiments, the PASS module 100 can be embodied in one or several handheld devices. FIG. 2B depicts one such embodiment in which the PASS module 100 is embodied in a handheld PASS unit 240. In some embodiments, the handheld PASS unit 240 can comprise all or some of the modules and components of the PASS module 100.

In some embodiments, and as depicted in FIG. 2B, the handheld PASS unit 240 can comprise a hand device 242. The hand device 242 can be configured to be held in the hand of a user. The hand device 242 can be configured to collect scan data, to store and/or process scan data, and to transmit the scan data to other systems and/or components of other systems.

As depicted in FIG. 2B, the hand device 242 can comprise a screen 244 and a keyboard 246. In some embodiments, the screen 244 can be configured to provide outputs to the user such as, for example, instructions and/or prompts, and the keyboard 246 can be configured to allow a user to provide inputs to the hand device 242. Although the hand device 242 depicted in FIG. 2B includes a screen 244 and a keyboard 246, the hand device 242 can comprise any number of features configured to provide outputs to a user and to receive inputs from a user, including, for example, a speaker and a microphone.

As further seen in FIG. 2B, the hand device 242 includes a printer 248. In some embodiments, the printer 248 can correspond to the printing module 118 of the PASS module 100, and can be configured to print labels for applying to an item. As also seen in FIG. 2B, the hand device 242 can include an antenna 250. In some embodiments, the antenna can be configured to communicate with other devices of the handheld PASS unit 240, and/or to communicate with other systems and/or components and modules of other systems.

The handheld PASS unit 240 can further include a scanner 252. In some embodiments, the scanner 252 can correspond to the scanner module 108 of the PASS module 100. In some embodiments, the scanner 252 can comprise a camera, a barcode reader, and/or any other device capable of gathering information from the item. In some embodiments, the scanner 252 can be configured with a trigger 254. In some embodiments, for example, the depressing of the trigger 254 can activate the scanner 252 to collect and generate scanned data from the item.

As depicted in FIG. 2B, the scanner 252 can further comprise an antenna 256. In some embodiments, the antenna 256 of the scanner 252 can be configured to allow communication between the scanner 252 and the hand device 242. Thus, in some embodiments, the antenna 256 of the scanner 252 can be used to transmit scanned data from the scanner 252 to the hand device 242.

While just a few of the features and functions of the handheld PASS unit 240 have been described in relation to FIG. 2B, the handheld PASS unit 240 can include features corresponding to the some or all of the features and or modules of the PASS module 100.

A person of skill in the art will recognize that the handheld PASS unit 240 can comprise more or fewer components and modules than those listed herein, and that the present disclosure of the handheld PASS unit 240 is not limited to the specific embodiment disclosed herein.

The PASS System

Figure 3:
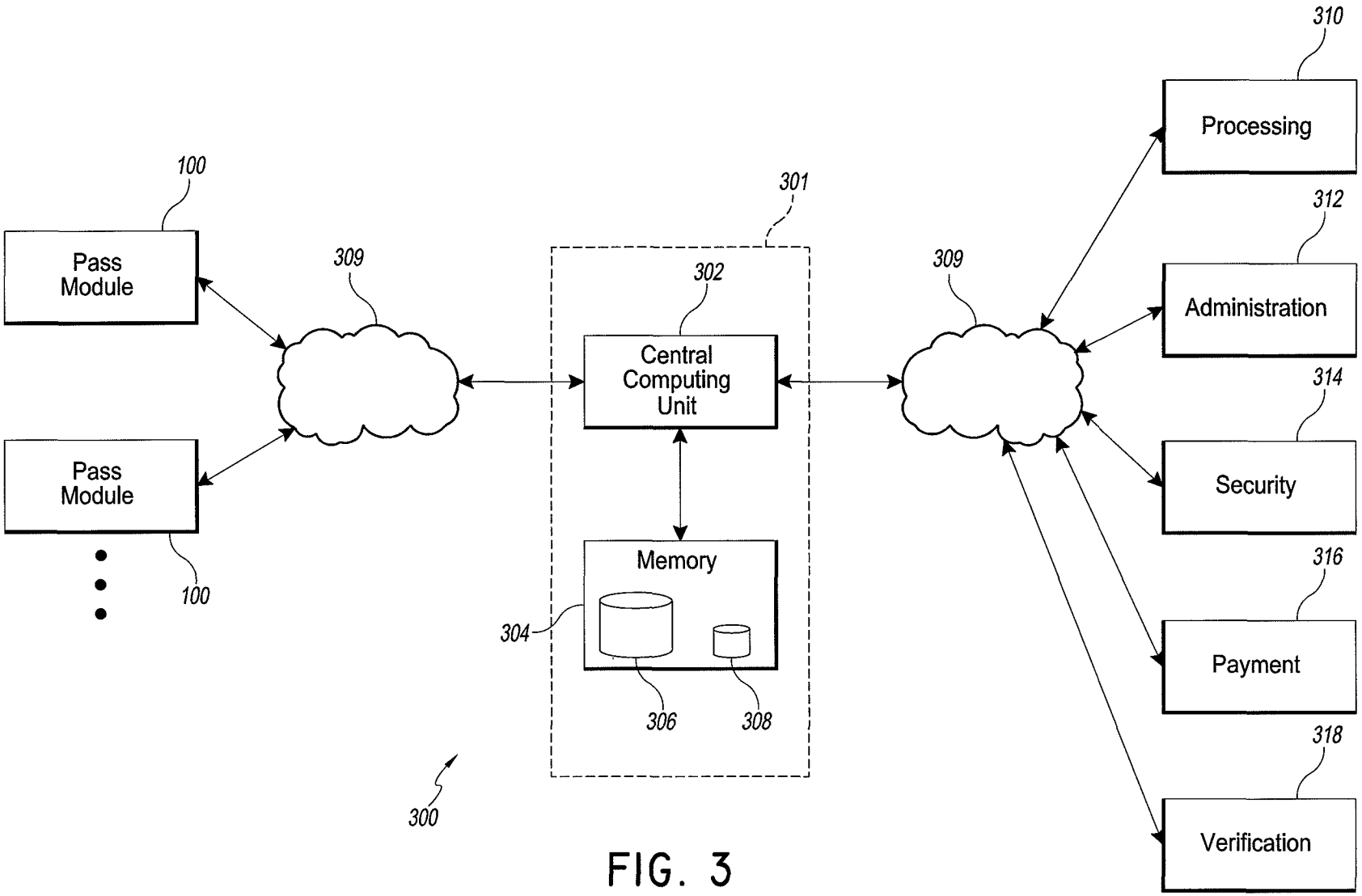
FIG. 3 is a schematic illustration of one embodiment of a PASS system.

Some embodiments of systems for item processing relate to a PASS system 300 as depicted in FIG. 3. The PASS system 300 can be configured to perform item processing functions relating to, for example, revenue protection, the requesting of actions relating to an item, sorting functions including sorting into routes and/or into delivery sequences, task management relating to items, random sampling and/or sampling of items, change of addressing for items, employee management relating to item processing, and item redirect. Each of these aspects of the tasks that can be performed by the PASS system 300 will be discussed in further detail below.

The PASS system 300 can comprise a variety of components, modules, and systems. In some embodiments, the PASS system 300 can be located in a single location, and in some embodiments, all of the modules and components and features of the PASS system 300 can be located in a single place. In other embodiments, the modules, components, and other features of the PASS system 300 can be located in different locations and can be in communicating connection with each other. The PASS system 300 can comprise a wide range of features and components, and is not limited to any specific components and/or modules or any specific functions.

As seen in FIG. 3, the PASS system 300 can comprise a PASS computing system 301. The PASS computing system 301 can be configured to receive inputs, such as information, from the other modules and/or components of the PASS system, to process these inputs, to store these inputs, and to provide instructions to the other modules and/or components of the PASS system 300. As seen in FIG. 3, the PASS computing system can comprise, for example, a central computing unit 302 connected to a memory 304.

The central computing unit 302 can be configured to receive inputs from the other components and/or modules of the PASS system 300 and provide instructions to the other components and/or modules of the PASS system 300. In some embodiments, for example, the central computing unit 302 can comprise one or more processors, one or more computers, and/or any other feature or component capable of performing processing operations. In one specific embodiment, the central computing unit is a supercomputer as disclosed in U.S. patent application Ser. No. 13/083,396 filed on Apr. 8, 2011, the entirety of which is incorporated by reference herein.

As further depicted in FIG. 3, the central computing unit 302 of the PASS computing system 301 can be in communicating connection with a memory 304. The memory 304 can comprise a variety of information including, for example, stored instructions to direct the operation of the central computing unit 302 and the operation of the PASS system 300. In some embodiments, the memory 304 can be physically located at and/or in the PASS computing system 301, and in some embodiments, the memory can be located remote from the PASS computing system 301.

The memory 304 can include, for example, RAM memory, flash memory, ROM memory, EPROM memory, EEPROM memory, registers, hard disk, a removable disk, a CD-ROM, or any other form of storage medium known in the art. The memory can include, for example, software, at least one software module, instructions, steps of an algorithm, or any other information. In some embodiments, the central computing unit 302 can perform processes in accordance with instruction stored in the memory 304. These processes can include, for example, controlling features and/or components of the PASS computing system 301, requesting and/or receiving information from features and/or components of the PASS system 300, transmitting instructions and/or control signals to features and/or components of the PASS system 300, requesting information from an administrator, transmitting information to the administrator, processing information received from features and/or components of the PASS system 300, processing information received from the administrator, and/or any other desired processes.

In some embodiments, the memory 304 can comprise one or several databases. FIG. 3 depicts one embodiment of a PASS system 300 in which the memory 304 comprises a first database 306 and a second database 308. In some embodiments, for example, the databases in the memory 304 can relate to the different modules of the PASS system 300. In some embodiments, the databases can include information relating to the functional state of the components and/or features of the other modules, service requests by the other features and/or modules.

The databases found in the memory 304 can, for example, include information relating to the users of the PASS system 300. In some embodiments, this information can include information relating to a user's or a group of users' output and/or work product, to the amount of time that these users have spent using the PASS system 300, and/or any other work- and or efficiency-related parameter.

The databases found in the memory 304 can include, for example, scan data. In some embodiments, for example, this scan data can be used to detect if a label has been used multiple times for different items. In some embodiments, this scan data can be used to determine if the amount paid for a service matches the actual cost of providing the service and/or the actual cost for receiving the service. In some embodiments in which the memory 304 comprises one or more databases including scan data, the memory 304 can comprise a first database 306 that is a match database. In some embodiments, the match database can include information relating to labels that have already been used in association with at least two items. In some embodiments, the match database can include information relating to labels that have been used multiple times during some time period such as, for example, in the past six years. In some embodiments, for example, scan data stored in the match database can be the entire scan data, or it can be a compressed portion of the scan data such as, for example, a hash generated from the scan data that uniquely identifies the scan data.

In some embodiments of the memory 304, a second database 308 can comprise a scan database. In some embodiments, the scan database can comprise the scan data for all scans in a certain period of time. In some embodiments, and in contrast to the match database, the scan database can comprise the complete scan data for all the scans taken in, for example, the past six months. In some other embodiments, the scan database can comprise the scan data for all scans taken in the past six months that have not been identified as already being used multiple times. In the event that a label is used multiple times, its scan data can be transferred from the scan database to the match database.

In some embodiments of the memory 304, the memory can comprise an action database. An action database can comprise a list of requested actions to be performed on an item. In some embodiments, these actions can include redirecting an item from one destination point to a new destination point, removing an item from circulation, testing and/or sampling an item, seizing an item, evaluating the contents of an item and/or the physical characteristics of an item, and/or performing an investigation relating to the item.

In some embodiments, the memory 304 can comprise an account database. In some embodiments, for example, the account database can comprise account information relating to people generating labels and submitting items. In some embodiments, the account database can include information relating to past transactions, relating to the present transaction, relating to methods of payment, identifying the account holder, and/or any other account-related information.

In some embodiments, the memory 304 can comprise a route database. In some embodiments, the route database can include information dividing a geographic area into routes. In some embodiments, these routes can be static and thus remain constant. In some embodiments, these routes can be dynamic and the route information stored in the database can comprise a function that varies the route based on variables such as the day of the week, the amount of items to be delivered, and/or any other variables. Thus, in some embodiments in which the route information in the database is dynamic, the designated route may change based on the day of the week that an item is delivered and the number of items that should be delivered that day.

Some embodiments of the memory 304 include an address database. In some embodiments, for example, the address database can include a list of recipients who have indicated that their address has changed or will be changing. In some embodiments, for example, the address database can include a list of old addresses of recipients who address is changing and/or has changed and a list of the new addresses for recipients whose address is changing and/or has changed. In some embodiments, the address database can further include date information indicating when the address change is to take place, the duration of time for which items addressed to the old address should be forwarded to the new address, and any other information, such as delivery preferences.

In some embodiments, for example, the memory 304 can comprise a sortation database including information relating to how the scanned items should be sorted.

A person of skill in the art will realize that the memory 304 can comprise any number of databases and that the memory 304 is not limited to the specific databases outlined herein.

The PASS system 300 can, as depicted in FIG. 3, include a communications network 309. The communications network 309 can comprise any feature and/or communications system to allow the different features and/or modules of the PASS system 300 to communicate with each other. In some embodiments, the communications network 309 can comprise a wireless communications network, a wired communications network, and/or any other communications network. In some embodiments, the communications network 309 can allow communications via existing networks such as a cellular network, a local area network, a wide area network, a telephone network, and/or any other existing communications network.

As depicted in FIG. 3, some embodiments of the PASS system 300 can include one or more PASS modules 100. As discussed above in greater detail, the PASS module 100 can be configured to generate scan data and provide that scan data to another system and/or modules and components of another system. The PASS module 100 can be further configured to receive instructions and/or outputs from another system and/or other components of another system. In the context of the PASS system 300, the PASS module 100 can be configured to communicate with the central computing unit 302 and provide scan data and other information relating to the item to the central computing unit 302 and to receive instructions and/or other information from the central computing unit 302.

The PASS system 300 can further include, for example, a processing module 310. In some embodiments, for example, the processing module 310 includes all equipment and/or components other than PASS modules 100 involved in the processing of items. These can include, for example, scanners, sorters, and/or any other similar equipment. In some embodiments, features and/or components of the processing module 310 are configured to scan items, to determine one or several properties of items, to sort items, and/or to dispose of items. As depicted in FIG. 3, the processing module 310 is in communicating connection with the central computing unit 302. Thus, the processing module 310 can provide information relating to items that have passed through the processing module 310 to the central computing unit 302. Further, the processing module 310 can receive instructions from the central computing unit 302 relating to items passing through the processing module 310.

The PASS system 300 can further include an administration module 312. In some embodiments, for example, the administration module 312 can be configured to monitor the operations of the PASS system 300, to monitor employee and/or user efforts relating to the PASS system 300, to provide inputs to the PASS system 300 to direct the operation of the PASS system 300, and/or any other desired functions. In some embodiments, the administration module 312 can comprise one or several computing devices and/or one or several terminals. In some embodiments, the administration module 312 can be configured to allow an administrator to provide inputs to the PASS system 300 and to receive outputs from the PASS system 300. In some embodiments, these inputs relate to the directing of the efforts of the PASS system 300 and the directing of the operation of the PASS system 300. In some embodiments, these outputs can relate to the functioning of the PASS system 300, data generated by the PASS system, and/or any other desired output. As seen in FIG. 3, the administration module 312 can communicate with the other modules of the PASS system 300, and in particular communicate with the central computing unit 302 via the communications network 309. Thus, the administration module 312 can provide inputs to the central computing unit 302 and receive outputs from the central computing unit 302.

In some embodiments, and as seen in FIG. 3, the PASS system 300 can include a security module 314. In some embodiments, for example, the security module can be configured to allow a user and/or security administrator to provide security-related input to the PASS system 300 and to receive security-related outputs from the PASS system 300. In some embodiments, for example, the security module 314 can comprise a terminal, a computing device, and/or any other hardware or software capable of providing inputs to the PASS system 300 and receiving outputs from the PASS system 300. In some embodiments, the security-related inputs can relate to fraudulent activities such as, for example, account fraud including unapproved use of a user account, label fraud including use of duplicate, invalid, and/or improper labeling, and payment fraud including, credit card theft, I.D. theft, and the like. In some embodiments, the security-related inputs can related to criminal activities such as, for example, an item containing illegal contents, an item sent with criminal intent such as, for example, a destructive device, and/or any other criminal-related content.

In some embodiments, the security-related input can further include a requested action related to the designated item, and an association between the requested action and a specified item. Thus, the security-related input can identify an item and identify an action to be taken in regards to that item. In some embodiments, the security-related inputs can be provided by a third party, such as, an investigative and/or police service, by a bank, and/or any other security related third party.

In some embodiments, the security-related outputs can include, for example, the present location of an item, the location of the item at which point the requested action was taken, the resolution of the security concern and/or of the action, and whether the requested action is allowed. As depicted in FIG. 3, the security module 314 can communicate via the communications network 309 with the other components of the PASS system 300 including, for example, the central computing unit 302. Thus, the security module 314 can provide inputs to the central computing unit 302 and receive outputs from the central computing unit 302.

As depicted in FIG. 3, some embodiments of the PASS system 300 can comprise, for example, a payment module 316. In some embodiments, for example, the payment module 316 can be configured to provide payment-related inputs and receive payment-related outputs. In some embodiments, for example, a payment module 316 can be configured to track information relating to a group of items and to determine cost of shipping or providing services to that group of items. Thus, in some embodiments in which a group of items is provided for receiving services and an exact payment amount is not known, the payment module 316 can, in connection with the other components and/or modules of the PASS system 300, indicate the labels for which a cost of providing services needs to be determined, and receive information relating to the determined cost of the services provided for those items. As depicted in FIG. 3, the payment module 316 can be in communicating connection with the other modules of the PASS system 300 via the communications network 309.

As further depicted in FIG. 3, the PASS system 300 can further include a verification module. In some embodiments, for example, the verification module 318 can be configured to review information relating to potential duplicate labels and/or other potential fraudulent activities to determine whether or not a duplicate label has been created and/or whether a fraudulent activity has been perpetrated. In some embodiments, for example, the verification module can comprise a variety of hardware and/or software capable of receiving the various inputs relating to a potential duplicate label and/or potential fraudulent activity and compare this information to determine whether or not a duplicate label has been used and/or whether a fraudulent activity has been perpetrated. In some embodiments, for example, the verification module can comprise one or more workstations and one or more users. In some embodiments, the information can be displayed on a monitor at a work station to a user. The user can then, based on the information displayed on the monitor, determine whether or not a duplicate label has been used and/or whether a fraud has been perpetrated. The user can then provide an indication as to whether the label is a duplicate and/or whether a fraud has been perpetrated, which information can be communicated from the verification module 318 to the other modules of the PASS system 300 via the communications network 309.

A person of skill in the art will recognize that the PASS system 300 can comprise more or fewer modules than those depicted in FIG. 3. A person of skill in the art will further recognize that the PASS module can comprise and perform more or fewer functions than those described specifically above in relation to FIG. 3. A person of skill in the art will further appreciate that the modules and/or components of the PASS system 300 can be replicated so as to have any number of any of the above-specified modules such as, for example, one PASS module 100, two PASS modules 100, and/or any other number of PASS modules 100.

Methods of Using the PASS Module

Figure 4:
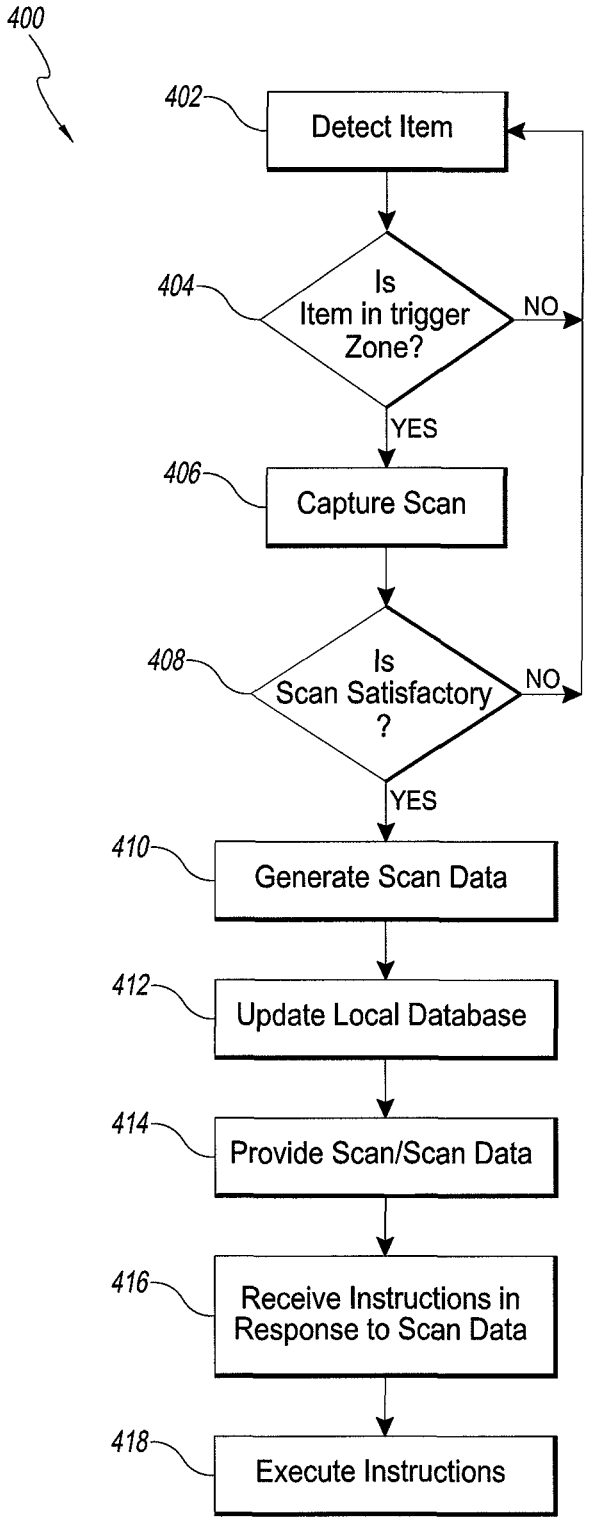
FIG. 4 is a flowchart illustrating one method for operating a PASS module.

The PASS module 100 can be used in connection with other components of the PASS system 300 for item processing. FIG. 4 is a flowchart illustrating one embodiment of a method 400 for using the PASS module 100. The process begins at block 402 when the scanner module 108 detects an item. In some embodiments, the scanner module 108 can detect an item by identifying qualifying labels and/or other features on the item. In some embodiments, a processor located within the scanner module 108 can detect the item, and in other embodiments the processor 102 can receive signals from the scanner module 108 and the processor 102 can detect the item.

After the item is detected, the process 400 proceeds to decision state 404 and the PASS module 100 determines if the item is in the trigger zone. In some embodiments, for example, this determination can be made by the processor 102 and in some embodiments in which the scanner module 108 comprises a processor, this determination can be made by the scanner module 108. In some embodiments, for example, this determination can be made by determining whether a designated portion of the item such as one or several of the labels is located within a specified portion of the trigger zone. If the PASS module 100 determines that the item is not in the trigger zone, then the process returns to block 402 and waits for detection of an item.

If the PASS module 100 determines that the item is in the trigger zone, then the process 400 moves to block 406 and the PASS module 100 captures a scan of the item. In some embodiments, for example, the scanner module 108 of the PASS module 100 can capture the scan. In some embodiments, for example, the captured scan can comprise a captured image taken by the camera 210 of the item.

After the scan is captured, the process 400 moves to decision state 408 and the PASS module 100 determines if the scan is satisfactory. In some embodiments in which the scanner module 108 comprises a processor, the scanner module 108 can determine if the scan is satisfactory. In some embodiments in which the scanner module 108 does not include a processor, the processor 102 of the PASS module 100 can determine if the scan is satisfactory. In some embodiments, the determination of whether the scan is satisfactory can be made based on the application of a number of factors including, for example, whether the information in the label and/or in the labels on the item is extractable. Thus, for example, if the scan image does not have sufficient resolution, focus, or other optical properties to allow the extraction of information from the label and/or labels, then the scan can be determined to be unsatisfactory. In the event that the scan is determined to be unsatisfactory, then the process 400 returns to block 402 and waits to detect an item.

If the scan is satisfactory, then the process 400 moves to block 410 and the PASS module generates scan data. In some embodiments, the scan data is data generated from the information relating to the item and captured by the scanner module 108. In some embodiments, the generation of scan data can include converting the captured scan from an image into a text string. In some embodiments, the generation of the scan data can include extracting information from computer-readable codes found in the scan image. In some embodiments, this can be done by the processor 102 of the PASS module 100 and/or a processor associated with the scanner module 108.

After the scan data is generated, the process 400 moves to block 412 and the PASS module 100 updates the local database. In some embodiments, this can include, for example, the communication of scan data, which can be data generated from the scan, from the processor 102 to the memory 104 for storage in database 106. In some embodiments, this update of the local database can also include inputting the captured scan into the database 106 in memory 104.

After the local database is updated, the process 400 moves to block 414 and the PASS module 100 provides the scan and/or scan data. In some embodiments, the PASS module 100 can provide the scan and/or scan data to the PASS computing system 301. In some embodiments, providing the scan and/or the scan data can include the processor 102 sending instructions to the communications module 114 to transmit the scan and/or the scan data to the PASS system 300 and/or to other components of the PASS system 300.

After the scan and/or scan data is provided, the process 400 moves to block 416 and the PASS module 100 receives instructions produced in response to the provided scan data and/or the provided scan. In some embodiments, these instructions can be received via the communications module 114 and can originate from other components of the PASS system 300. In some embodiments, these instructions can include instructions relating to the disposal of the item, relating to an action to be performed on the item, and/or relating to additional information that must be collected from the item and/or relating to the item.

After the instructions have been received, the process 400 moves to block 418 and the PASS module 100 executes the instructions. In some embodiments, the instructions can be executed, for example, by the processor 102 and/or by the other modules of the PASS module 100. In some embodiments, the execution of the instructions can comprise providing an instruction to a user to perform a task relating to the item, to take an action on the item, or to collect information from the item.

A person of skill in the art will recognize that the process 400 outlined above can have more or fewer steps than those outlined specifically above. A person of skill in the art will further recognize that the above outlined steps can be performed in the same order or a different order than outlined above.

Methods for Item Processing with the PASS System

Figure 5:
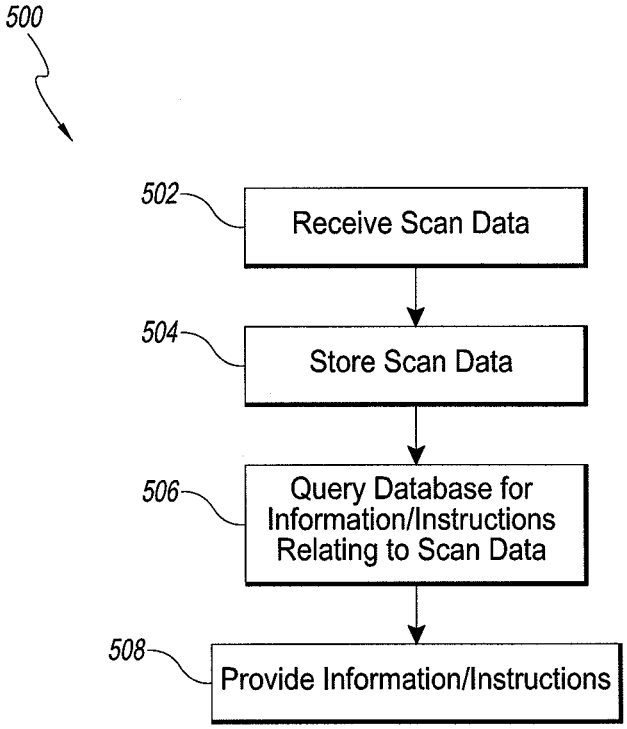
FIG. 5 is a flowchart illustrating one method for operating a PASS system.

The PASS system 300 can be used in item processing, and specifically can be used to collect information from an item and to use the collected information to determine an action relating to the item. FIG. 5 is a flowchart illustrating one embodiment of a process for using the PASS system 300 in item processing in connection with other components of a PASS system 300. The process 500 begins at block 502 and the central computing unit 302 receives scan data. In some embodiments, for example, the received scan data can be generated by a PASS module 100. The received scan data can be the entire scanned image and/or the data generated from the scanned image.

After the scan data is received, the process 500 moves to block 504 and the PASS computing system stores the scan data. In some embodiments, for example, the central computing unit 302 of the PASS computing system 301 can transmit the scan data to the memory 304. In connection with this, in some embodiments, the central computing unit 302 can provide instructions to the memory 304 to store the scan data within a database in the memory 304.

After the scan data is stored, the process 500 moves to block 506 and the PASS computing system 301 queries the database for information and/or instructions relating to the scan data. In some embodiments, for example, the querying of the database for information and/or instructions relating to scan data can comprise the central computing unit 302 querying the memory 304 and/or specifically the first database 306 and/or the second database 308 for information and/or instructions relating to the scan data. In some embodiments, the information and/or instructions in the database relating to the scan data can originate at the other modules and/or components of the PASS system 300. Some specific embodiments of queries for instructions and/or information relating to the scan data will be discussed at greater length below.

After the PASS computing system 301 queries the database for information and/or instructions relating to the scan data, the process 500 moves to block 508 and the PASS computing system 301 provides information and/or instructions. In some embodiments, for, example, this information and/or instructions can be provided to other modules of the PASS system 300 including, for example, the PASS module 100. Specifically, in some embodiments, for example, the information and/or instructions can be provided to the communications module 114 of the PASS module 100.

In some embodiments, for example, processes for using the PASS computing system 301 can be specifically directed to processes for revenue protection. FIG. 6 through FIG. 9 provide examples of processes for using the PASS computing system 301 for revenue protection and/or for specific aspects of revenue protection.

Figure 6:
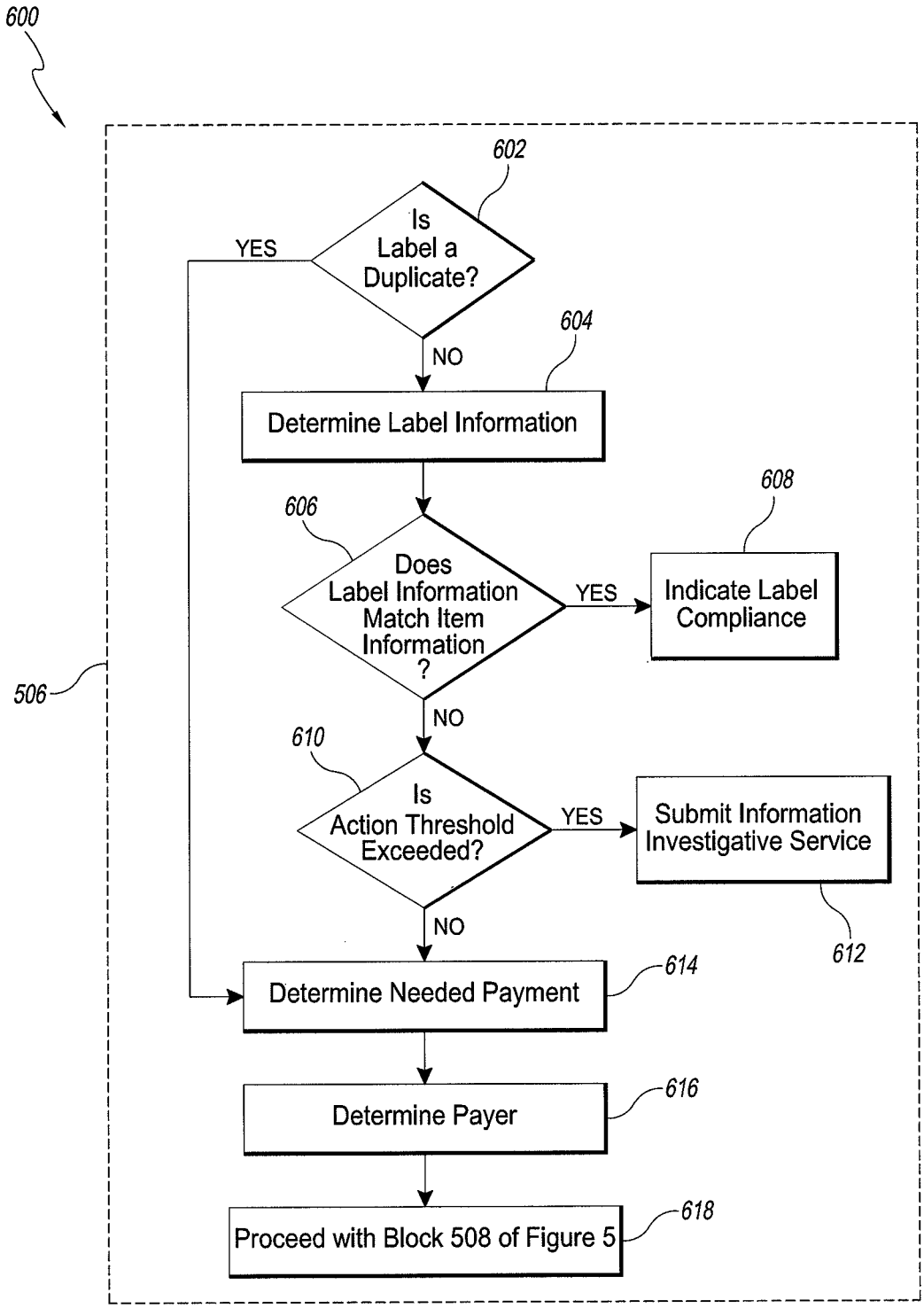
FIG. 6 is a flowchart illustrating one method for using a PASS system for revenue protection.

FIG. 6 depicts one embodiment of a process for using the PASS computing system 301 for revenue protection. As seen in FIG. 6, the process 600 can be performed as a part of the process 500 for using the PASS computing system for item processing, and specifically, the process 600 can be performed as a part of block 506, shown in FIG. 5.

The process 600 for using the PASS computing system 301 for revenue protection begins at decision state 602 when the PASS computing system 301 determines if the label is a duplicate. In some embodiments, for example, the determination of whether a label is a duplicate can involve comparing received scanned data with data stored in the memory 304 of the PASS computing system 301. The details of determining whether a label is a duplicate will be discussed at further length below.

If the PASS computing system 301 determines that the label is not a duplicate, the process 600 proceeds to block 604 and the PASS computing system 301 determines the label information. In some embodiments, for example, the determination of the label information can be performed by the central computing unit 302. This determination can include, for example, decoding the scan data associated with the label to uncover label information embedded in the scanned data. In some embodiments, for example, the determining of the label information can include decoding the scan data associated with the label and using that data to query another database which includes label information. In some embodiments, this database can be controlled and be a component of the PASS system 300, it can be a component of another system, and/or be a component of a third-party system. In some embodiments, the determining of the label information can comprise, for example, determining information relating to services associated with the label, physical properties of the item associated with the label, the specified recipient of the label, the specified sender of the item associated with the label, and the origination point of the item. In embodiments in which this information is embedded in the scan data, the decoding of the scan data can provide this desired information. However, in other embodiments in which this information is not encoded in the scan data, the decoding of the scan data may not provide this information. In that case the PASS computing system 301 may be directed to the database containing this information.

After the label information has been determined, the process 600 moves to decision state 606 and the PASS computing system 301 determines if the label information matches item information. In some embodiments, item information can include information relating to the physical properties of the item, such as, for example, the size and weight of the item, and services requested for the item. In some embodiments, label information can include user provided information relating to user asserted physical properties of the item and services requested by the user for the item.

In some embodiments, this determination of whether item information matches label information can include comparing the label information with collected item information. In some embodiments, the item information can be generated by one or more of the modules of the PASS system 300 and can be stored in one or more of the databases of the memory 304. In some embodiments, the item information can be generated before the determination of label information is made in block 604, and in some embodiments, the item information can be generated and/or ascertained after the label information is determined in block 604. Thus, in some embodiments, the item information can be generated at the prompting and/or at the instruction of the PASS computing system 301 and provided to one or more of the other modules of the PASS system 300. In some embodiments, for example, the item information can be generated at a PASS module 100 in response to instructions received from the PASS computing system 301. In some embodiments, the item information can comprise a preliminary set of item information, and a confirmed set of item information.

In some embodiments, modules of the PASS system 300 can provide preliminary item information. In some embodiments, the preliminary item is information that provides a non-determinative indication of some aspect relating to the item. In one specific embodiment, preliminary information can be collected by a processing module 310 at the time that an item passes the processing module 310, and this information can be provided to the PASS computing system 301. In such an embodiment, the processing module 310 can be configured to scan the item and to ascertain certain physical parameters of the item, which can be stored as the preliminary item information. Due to tolerances of the processing module 310, the preliminary item information generated by the processing module 310 may not be determinative of whether the label information matches the item information because the processing module 310 may not accurate capture information relating to physical parameters of the item. Thus, in some embodiments in which the label information does not match the preliminary item information, the PASS computing system 301 can provide instructions to the PASS module 100 to verify item information at the time that the item is scanned at the PASS module 100. In some embodiments, for example, the confirmed item information can be generated by, for example, the testing module 116 of the PASS module. This information can then be communicated from the PASS module 100 to the PASS computing system 301, and the determination can be made as to whether the label information matches the item information.

If the label information matches the item information, then the process 600 moves to block 608 and indicates that the label is in compliance.

If the label information does not match the item information, then the process 600 proceeds to decision state 610 and the PASS computing system 301 determines if an action threshold is exceeded. This threshold can include, for example, a number of times that a specific user has submitted items with label information that does not match the item information, a measure of the magnitude of the discrepancy, or any other threshold that provides an indication of intent to defraud the service provider. In some embodiments, for example, an action threshold can be established to differentiate between problems that can be resolved by the requesting of additional payment as compare with problems that require further, and potentially criminal, investigation. In some embodiments, this determination can be made by the central computing unit 302 based on instructions and information stored in the memory 304, and can include, for example, determining the number of times that a user associated with the item has submitted items with label information that does not match the item information. If the number of times the user has submitted items with such label information is larger than the threshold, then the central computing unit 302 determines that the action threshold is exceeded.

If it is determined that the action threshold is exceeded, then the process 600 proceeds to block 612 and the information is submitted for further processing, investigation, and/or to an investigative service. The investigative service can then use the provided information to build a case and/or to investigate the circumstances leading to the triggering of the investigation request.

Returning again to decision state 610, if the action threshold is not exceeded, then the process moves to block 614 and the PASS computing system 301 determines the required payment. Returning again to decision state 602, if the label is determined to be a duplicate, the process 600 likewise proceeds to block 614 and determines the required payment. In some embodiments, for example, the determination of the required payment can comprise comparing label information stored in the scan data with item information associated with the item. In some embodiments, this information can include the physical properties of the item, as well as the services requested in association with the item. In some embodiments, the physical properties of the item and the requested services can correspond to a service payment that can be the amount of money required to provide the requested services for an item with the current physical properties. This service payment can then be used to calculate a required payment. In some embodiments, for example, the required payment can comprise the difference between the previously made payment and the service payment.

After the needed payment is determined, the process 600 proceeds to block 616 and identifies and/or determines a payer. In some embodiments, for example, this determination can be made by one or several modules of the PASS system 300 including, for example, the PASS computing system 301, the PASS module 100, and/or the payment module 316. The process used to determine the payer will be discussed in further detail below.

After the payer is determined, the process 600 moves to block 618 and proceeds with block 508 of FIG. 5.

Figure 7:
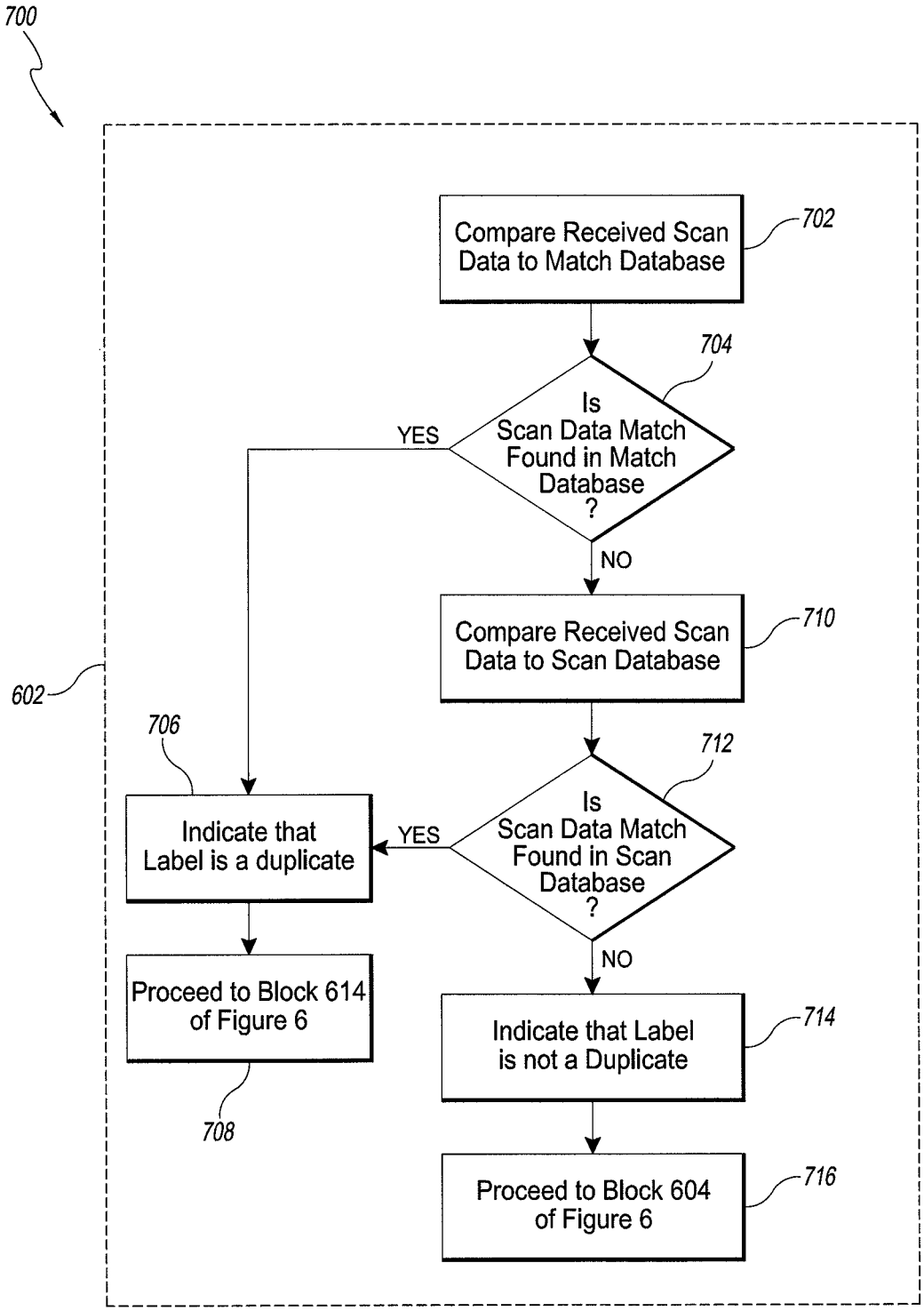
FIG. 7 if a flowchart illustrating one method for determining if a scanned label is a duplicate.

FIG. 7 is a flowchart illustrating a method 700 for determining whether a label is a duplicate, as indicated in decision state 602 as indicated in FIG. 6. As seen in FIG. 7, the process 700 can be performed as a part of the process of decision state 602, shown in FIG. 6.

The process 700 begins at block 702, wherein the received scan data is compared to the match database. In some embodiments, for example, this comparison can be performed by the central computing unit 302 which can, for example, access the match database found in the memory 304. As discussed above, in some embodiments, the match database can comprise information relating to the labels that have already been used multiple times. Thus, if the received scan data matches that of a label found in the match database the use of a fraudulent label is identified.

After the received scan data has been compared to the match database, the process 700 proceeds to decision state 704 wherein the PASS computing system 301 determines if the comparison performed in decision state 702 produced a match. This determination can be made by the central computing unit 302 querying the memory 304 for match database information.

If a match was indicated in decision state 704, the process 700 proceeds to block 706 and the PASS computing system 301 indicates that the label is a duplicate. After the label is indicated as a duplicate, the process 700 proceeds to block 708 and returns to block 614 of FIG. 6.

Returning again to decision state 704, if the scan data does not match information found in the match database, then the process 700 proceeds to block 710 and compares the received scan data to data in the scan database. In some embodiments, and as discussed above, the scan database can comprise information relating to all the scans generated in a designated time period. As also mentioned above, the scan database can be stored, for example, in the memory 304 of the PASS computing system 301. After the received scan data is compared to information in the scan database, the process moves to decision state 712 and the PASS computing system 301 determines if comparison in decision state 712 has produced a match. In some embodiments, this determination can be made by the central computing unit 302 of the PASS computing system 301. If it is determined that the scan data matches information found in the scan database, then the process 700 moves to block 706 and indicates that the label is a duplicate, after which the process 700 moves to block 708 and returns to block 614 of FIG. 6.

Returning again to decision state 712, if the scan data does not match information in the scan database, then the process 700 moves to block 714 and the PASS computing system 301 indicates that the label is not a duplicate. In some embodiments, indicating that the label is not a duplicate can include the central computing unit 302 providing such an indication to the memory 304 for inclusion in a database associated with the label.

After indicating that the label is not a duplicate, the process 700 moves to block 716 and returns to block 604 of FIG. 6.

Figure 8:
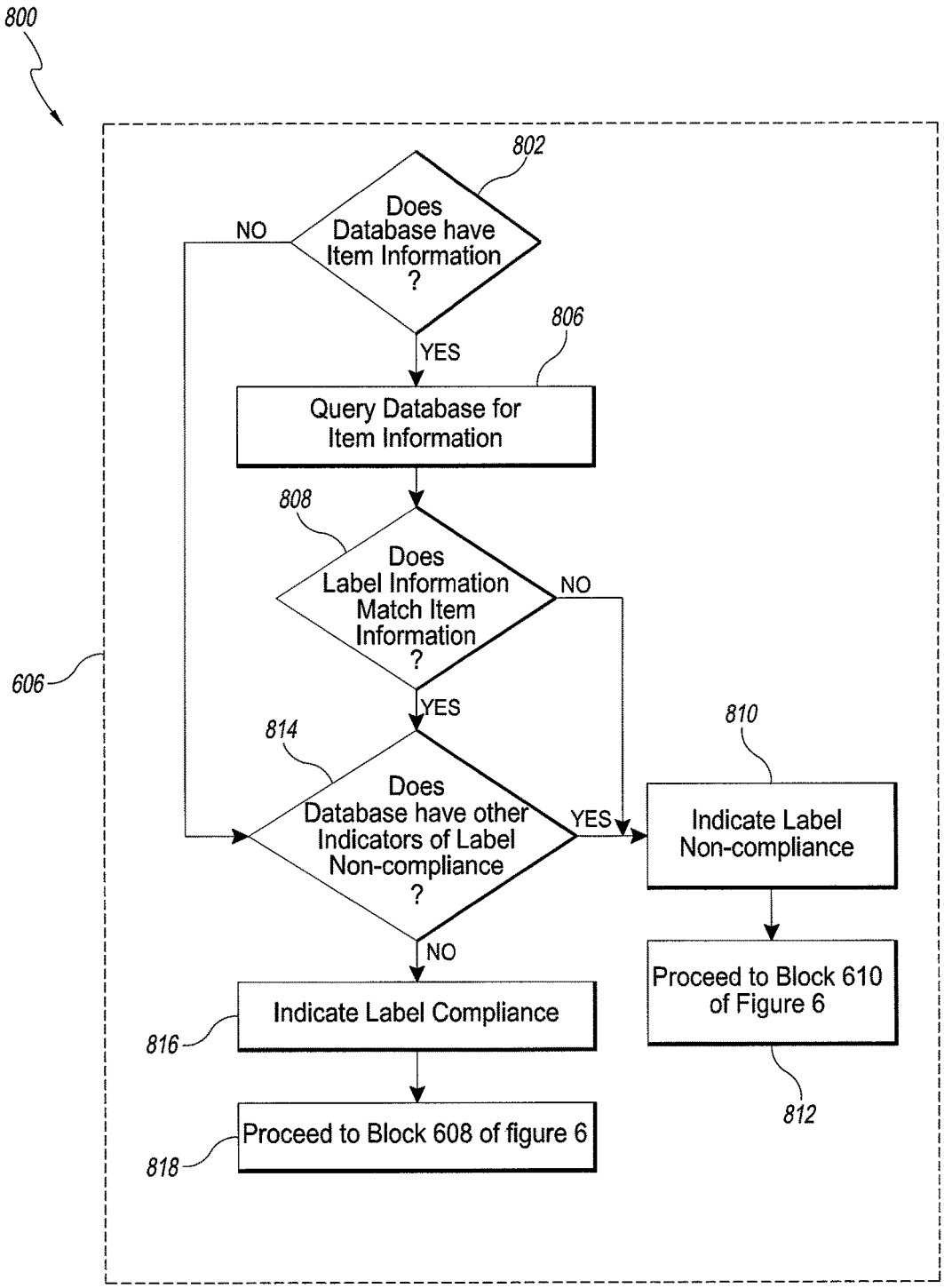
FIG. 8 is a flowchart illustrating one method for determining if label information associated with a scanned label matches item information.

FIG. 8 illustrates a flowchart illustrating a process 800 relating to revenue protection. As seen in FIG. 8, the process 800 can be performed as a part of the decision state 606, shown in FIG. 6. Decision state 606 is the decision state in which the determination is made as to whether the label information matches the item information.

The process 800 begins at decision state 802 wherein the PASS computing system 301 determines if the database includes item information. As mentioned above, in some embodiments, item information can be added to a database before the scan data is generated, and in some embodiments, item information can be generated in response to the generation of scan data.

If the database includes item information, then the process 800 proceeds to block 806 and the PASS computing system 301 queries the database containing the item information for the item information relating to the specific label in question. In some embodiments, this query can be made by the central computing unit 302 to the memory 304.

After querying the database for item information, the process 800 proceeds to decision state 808 wherein the PASS computing system 301 determines if the label information matches the item information retrieved from the database. As mentioned above relating to the processing module 310 of the PASS system 300, sometimes the accuracy of the components of the processing module 310 may not be sufficient to establish finalized item information. In the event that item information was generated by the processing module 310, or another module lacking sufficient accuracy to finalize the item information, the determination of whether label information matches item information may provide for tolerances within which label information is deemed to match item information. For example, in some embodiments, the item information identifying item weight may have been gathered using equipment having an accuracy within plus or minus one pound. In that case, the tolerance can be set so that the label information, read from the label on the item may be deemed to match the item information when the label information is within plus or minus one pound of the item information.

If it is determined that the label information does not match the item information, then the process 800 moves to block 810 and the PASS computing system 301 indicates label noncompliance. In some embodiments, this indication of label noncompliance can comprise the central computing unit 302 updating a database in the memory 304 with an indication of label noncompliance. After the label noncompliance is indicated, the process 800 proceeds to block 812 and returns to block 610 of FIG. 6.

Returning again to decision state 808, if it is determined that the label information matches the item information, then the process 800 proceeds to decision state 814 and the PASS computing system 301 determines whether the database has any other indicators of label noncompliance. In some embodiments, for example, the database may include other indicators of label noncompliance such as, for example, an indication that the labeling associated with the item indicated a flat rate box and/or flat rate package and that the parameters of the item associated with the label do not match those flat rate indications.

If the PASS computing system 301 determines that the database includes other indicators of label noncompliance, then the process 800 proceeds to block 810 and the PASS computing system 301 indicates label noncompliance which, as mentioned above, can include the central computing unit 302 adding an indicator to a database in the memory 304 of the noncompliance. After the label noncompliance is indicated, the process 800 proceeds to block 812 and returns to block 610 of FIG. 6.

Returning again to decision state 814, if the database does not have other indicators of label noncompliance, then the process 800 proceeds to block 816 and the PASS computing system 301 indicates label compliance. In some embodiments, the indication of label compliance can comprise the central computing unit 302 adding an indicator to a database in the memory 304 of the label compliance. After the label compliance is indicated, then the process 800 proceeds to block 818 and returns to block 608 of FIG. 6.

Figure 9:
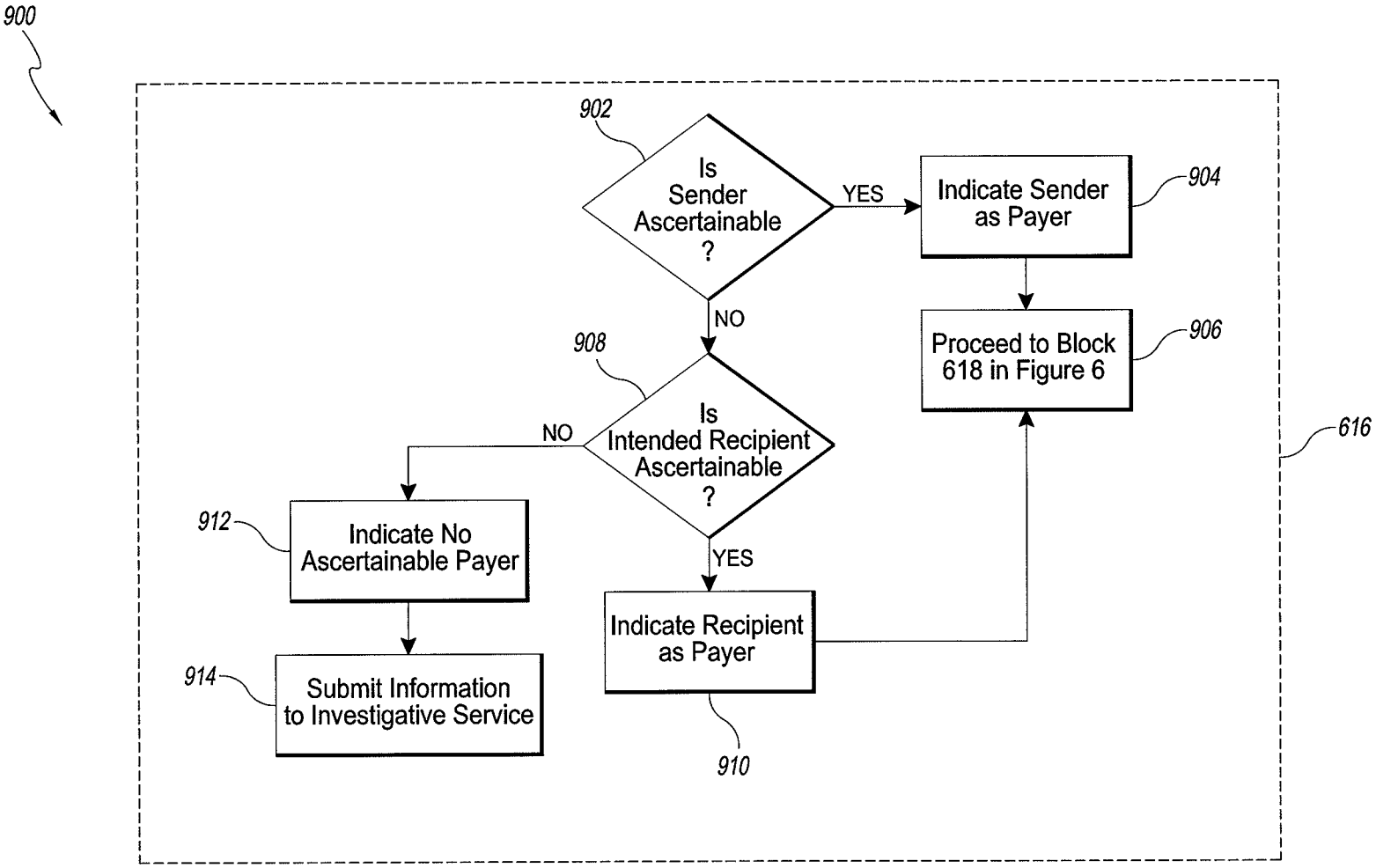
FIG. 9 is a flowchart illustrating one method for determining a payer.

FIG. 9 is a flowchart illustrating an embodiment of a process 900 for determining a payer, as indicated in block 616 of FIG. 6. As seen in FIG. 9, the process 900 can be performed as a part of the process 600, and specifically, the process 600 can be performed as a part of block 616, shown in FIG. 6. This process 900 is a part of revenue protection, and can be performed by the PASS system 300 and/or components and/or modules of the PASS system 300 including, for example, the PASS computing system 301.

The process 900 begins at decision state 902 wherein the PASS computing system 301 determines if the sender is ascertainable. In some embodiments, the determination of whether the sender is ascertainable can include querying a database found in the memory 304 for information relating to potential previous duplicate uses of the label and/or account information. If the label has been previously used, as indicated by an indication in a database in the memory 304 identifying the label as a duplicate, the sender can be ascertained by comparing the current sender with information from the database in the memory 304 identifying the previous sender. In the event the current sender is the same as the previous sender, it is assumed that the previous and current senders are the same and are the source of the duplication. Thus, if the previous and current senders are the same, then the sender is ascertainable. If the previous and current senders are not the same, then the sender is not ascertainable.

Similarly, in the event that label information does not match the item information, and a sender is indicated, then the sender is ascertainable. If a sender is not indicated, then the sender is not ascertainable.

If the PASS computing system 301 determines that the sender is ascertainable, then the process 900 proceeds to block 904 and the PASS computing system 301 indicates the sender as the payer. In some embodiments, the indicating of the sender as the payer can comprise, for example, the central computing unit 302 sending instructions to the memory 304 to update a database to indicate that the sender is the payer. After the sender is indicated as the payer, the process 900 proceeds to block 906 and proceeds to block 618 in FIG. 6. Returning again to decision state 902, if the sender is not ascertainable, then the process proceeds to decision state 908 and the PASS computing system 301 determines if the intended recipient is ascertainable. In some embodiments, this determination of whether the intended recipient is ascertainable comprises determining whether an intended recipient is indicated on the item. In the event that an intended recipient is indicated on the item, then the intended recipient is deemed to be ascertainable. In some embodiments, the determination of whether an intended recipient is indicated on the item can comprise the central computing unit 302 querying the memory 304 and/or the other modules of the PASS system 300 for scan data, and determining whether the scan data includes an intended recipient. In some embodiments, for example, determining the intended recipient may also comprise requesting that the PASS module 100 and/or other components of the PASS system 300 perform an additional scan of the item to capture any recipient information.

If the recipient is ascertainable, then the process 900 proceeds to block 910 and the PASS computing system 301 indicates the recipient as the payer. In some embodiments, the indicating of the recipient as the payer can comprise the central computing unit 302 sending instructions to the memory to add an indicator to a database indicating that the recipient is the payer. The process then proceeds to block 906 and returns to block 618 in FIG. 6.

Returning again to decision state 908, if the PASS computing system 310 determines that the intended recipient is not ascertainable, then the process 900 proceeds to block 912 and the PASS computing system 301 indicates that no payer is ascertainable. In some embodiments, indicating that no payer is ascertainable can comprise the central computing unit 302 providing instructions to the memory 304 to update a database with an indication that no payer is ascertainable. The process then proceeds to block 914 and scan data and information relating to the label is submitted to the investigative service. In some embodiments, and as an alternative to submitting information to the investigative service, the item is seized and disposed of.

A person of skill in the art will recognize that the processes for revenue protection outlined in the flowcharts in FIGS. 6 through 9 do not include all the steps, functions, or aspects of revenue protection. A person of skill in the art will further recognize that processes for using a PASS system 300 for revenue protection can comprise more or fewer steps, and the steps can be performed in a different order or in the same order as presented herein. Thus, a person of skill in the art will recognizes that processes for revenue protection are not limited to the specific embodiments disclosed herein.

Figure 10:
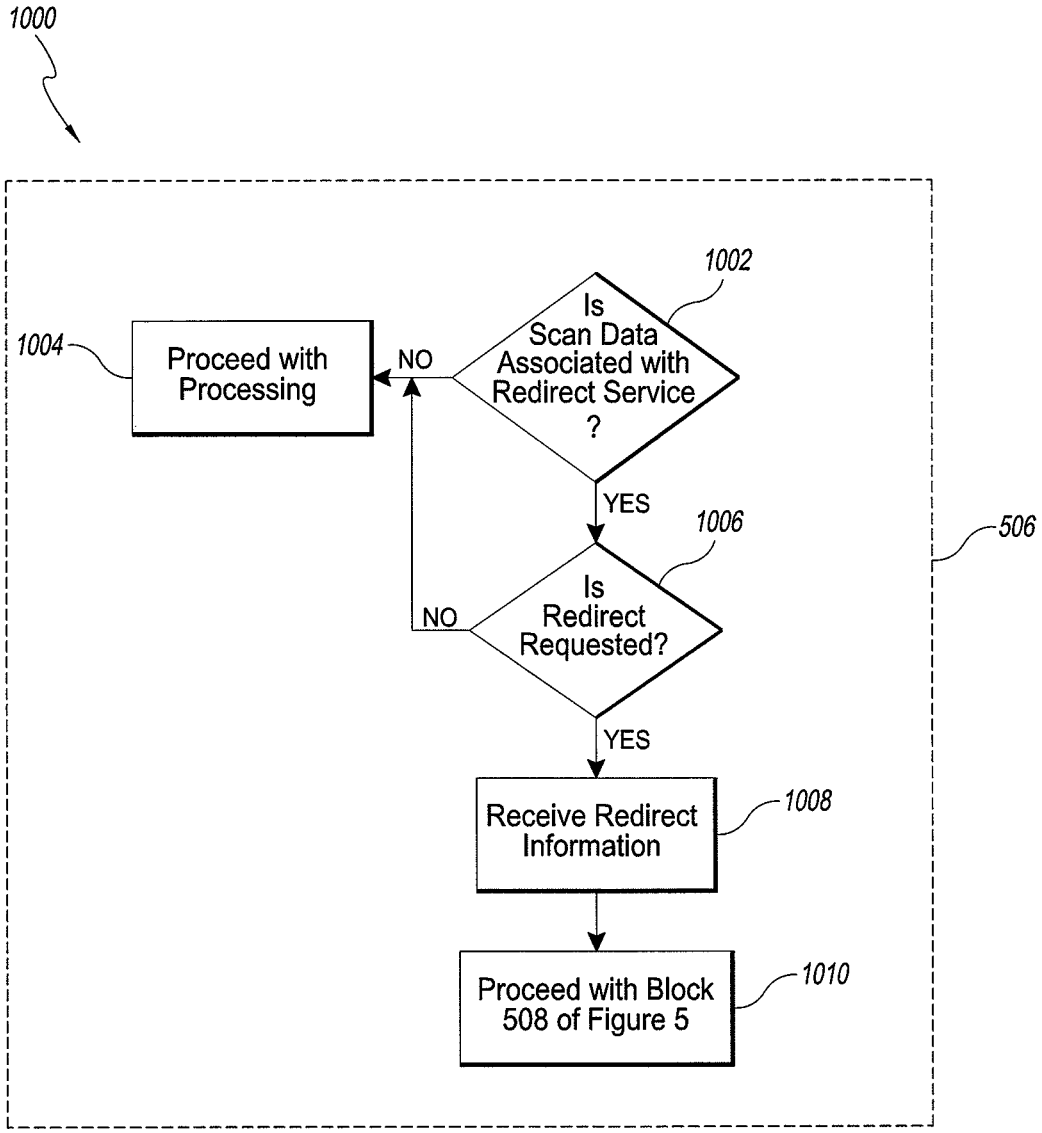
FIG. 10 is a flowchart illustrating one method for using a PASS system to prompt an action.

FIG. 10 depicts a flowchart illustrating a process 1000 for using a PASS system 300 to redirect an enroute item. As seen in FIG. 10, the process 1000 can be performed as a part of the process 500 for using the PASS computing system for item processing, and specifically, the process 1000 can be performed as a part of block 506, shown in FIG. 5.

In some embodiments, after an item has been received, a sender may decide to request different services and/or to redirect the item. The process 1000 in FIG. 10 provides the details for how this redirection may be accomplished.

The process 1000 begins at decision state 1002 and the PASS computing system 301 determines if scan data is associated with a redirect service. In some embodiments, this determination can include the central computing unit 302 querying the memory 304 for information relating to requested services. In some embodiments, the memory 304 may include an indication requesting a redirect of an item. Such a request may have originated, for example, from the sender so as to cause the entry of the redirect request indication in the memory 304. If it is determined that the scan data is not associated with redirect, then the process 1000 proceeds to block 1004 and proceeds with processing.

If it is determined that the scan data is associated with redirect services, then the process proceeds to decision state 1006 and the PASS computing system 301 determines if redirect is requested. In some embodiments, the decision state 1006 differentiates itself from the decision in decision state 1002 in that an item may be associated with redirect services, and thus it may qualify for redirect services, but redirect services may not have been requested in connection with the specified item.

In some embodiments, determining whether redirect is requested can comprise a central computing unit 302 querying the memory 304 for information relating to whether the redirect is requested. If the redirect is requested, the memory 304 can comprise information indicating such. If such information is not discovered in the memory, then the process 1000 proceeds to block 1004 and proceeds with processing.

If it is determined in decision state 1006 that redirect is requested, then the process 1000 proceeds to block 1008 and the central computing unit 302 receives the redirect information. In some embodiments, for example, the redirect information can be received from the memory 304. In some embodiments, the redirect information can be received from other modules and/or components of the PASS system 300. In some embodiments, the redirect information can be received from a third-party source, such as a third-party service provider, a third-party database, or any other third-party source.

After the redirect information is received, the process 1000 proceeds to block 1010 and proceeds with the activities of block 508 of FIG. 5.

A person of skill in the art will recognize that the process 1000 for using a PASS system 300 can comprise more or fewer steps than those illustrated herein. A person of skill in the art will further recognize that the steps illustrated herein can be performed in the same order or a different order than described herein. Thus, a person of skill in the art will recognize that the process 1000 for performing redirect services is not limited to the specific embodiment described herein.

Figure 11:
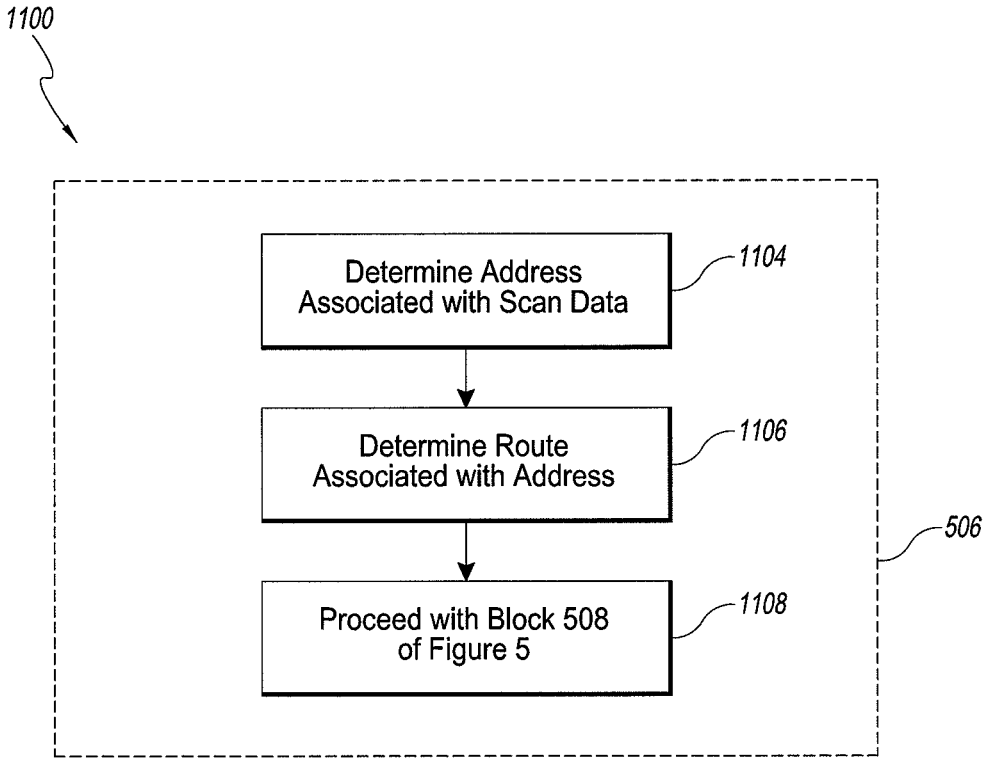
FIG. 11 is a flowchart illustrating one method for using a PASS system in the sortation of one or several items into one or several routes.

FIG. 11 is a flowchart illustrating a process 1100 for using a PASS system 300 in item processing. Specifically, the process 1100 relates to using a PASS system 300 for sorting items into routes. As seen in FIG. 11, the process 1100 can be performed as a part of the process 500 for using the PASS computing system for item processing, and specifically, the process 1100 can be performed as a part of block 506, shown in FIG. 5.

In some embodiments, items are sorted into routes to facilitate delivery. As mentioned earlier in the application, this sorting is traditionally done by a skilled person; however, changes in routes and/or loss of trained individuals can cause significant difficulties. Further, relying on skilled individuals to sort items into routes prevents the possibility of easily having different routes for different days of the week or for different circumstances.

Advantageously, the process 1100 eliminates the need for the skilled individual to make sorting decisions and allows for dynamic routing.

The process 1100 begins in block 1104 and the PASS computing system 301 determines the address associated with the scan data. In some embodiments, this determination can include, for example, decoding the scan data to ascertain the intended recipient of the item. In some embodiments, determining the address associated with the scan data can comprise querying a database including, for example, a third-party database, with scan data to determine an address that is associated with the scan data.

Once the address associated with the scan data is determined, the process 1100 moves to block 1106 and the PASS computing system 301 determines the route associated with the address. In some embodiments, determining the route associated with the address can comprise, for example, querying an address database and/or a route database. In some embodiments, an address database and/or a route database is queried to determine which delivery route the address associated with the scan data is associated with. Advantageously, as the route and/or address database can include dynamic routing information, block 1106 provides for the possibility of assigning an address to different routes depending on the circumstances in which the item is to be delivered such as, for example, the date of delivery, the day of the week of delivery, the number of items to be delivered, and/or the number of people available for delivery of items.

In some embodiments, the determination of which route is associated with the address can be made by the central computing unit 302, and the query of the address and/or route database can be made by querying the memory 304 and querying databases found in the memory 304.

After the route associated with the address is determined, then the process 1100 moves to block 1108 and proceeds with block 508 of FIG. 5.

In some embodiments, items are sorted not only into delivery routes, but also into delivery sequences. A delivery sequence can be, for example, a sorting of items to match a delivery order of the items; thus, for example, the items are ordered such that the first item to be delivered is positioned before the tenth item to be delivered in the delivery sequence.

Figure 12:
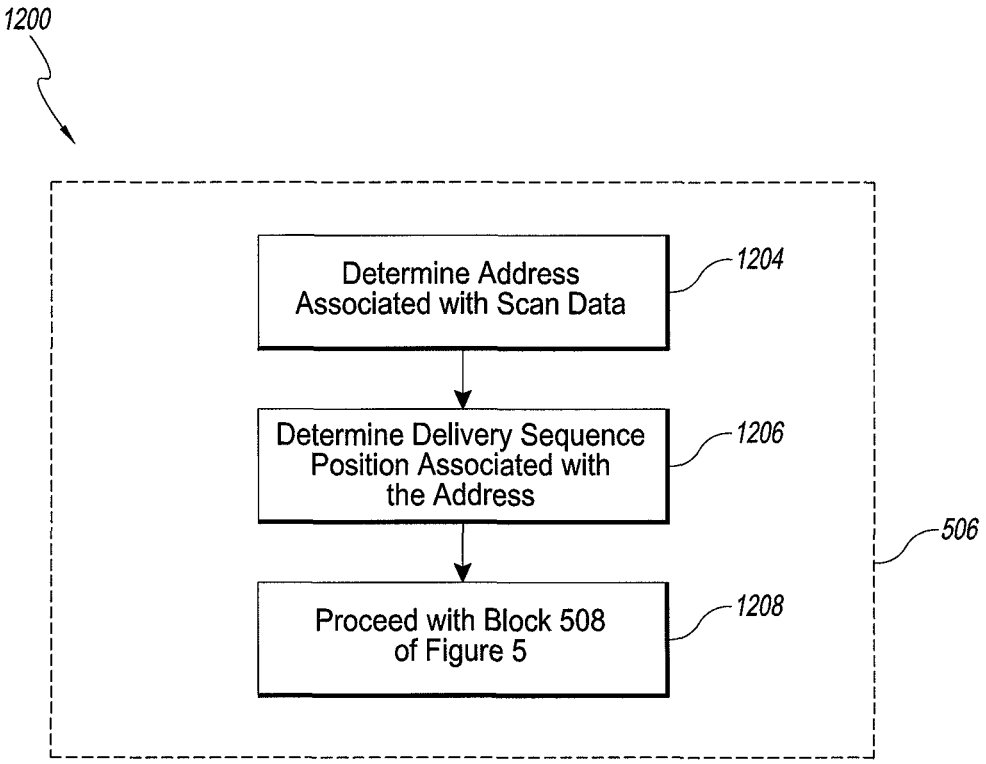
FIG. 12 is a flowchart illustrating one method for using a PASS system to sort items into a delivery sequence.

FIG. 12 is a flowchart illustrating a process for using a PASS system 300 to sort items into a delivery sequence. As seen in FIG. 12, the process 1200 can be performed as a part of the process 500 for using the PASS computing system for item processing, and specifically, the process 1200 can be performed as a part of block 506, shown in FIG. 5.

The process 1200 begins at block 1204 and the PASS computing system 301 determines the address associated with the scan data. In some embodiments, this determination can include, for example, decoding the scan data to ascertain the intended recipient of the item. In some embodiments, determining the address associated with the scan data can comprise querying a database including, for example, a third-party database, with scan data to determine an address that is associated with the scan data.

After the address associated with the scan data is determined, the process 1200 moves to block 1206 and the PASS computing system 301 determines the delivery sequence position associated with the address. In some embodiments, this determination can comprise the central computing unit 302 querying the memory 304 for delivery sequence information, and for information relating to the position of an address within the delivery sequence. In some embodiments, this query can further comprise requesting information relating to other scanned items and the desired relative position of the presently scanned item to the previously scanned items.

After the delivery sequence position associated with the address is determined, the process 1200 moves to block 1208 and proceeds with block 508 of FIG. 5.

Figure 13:
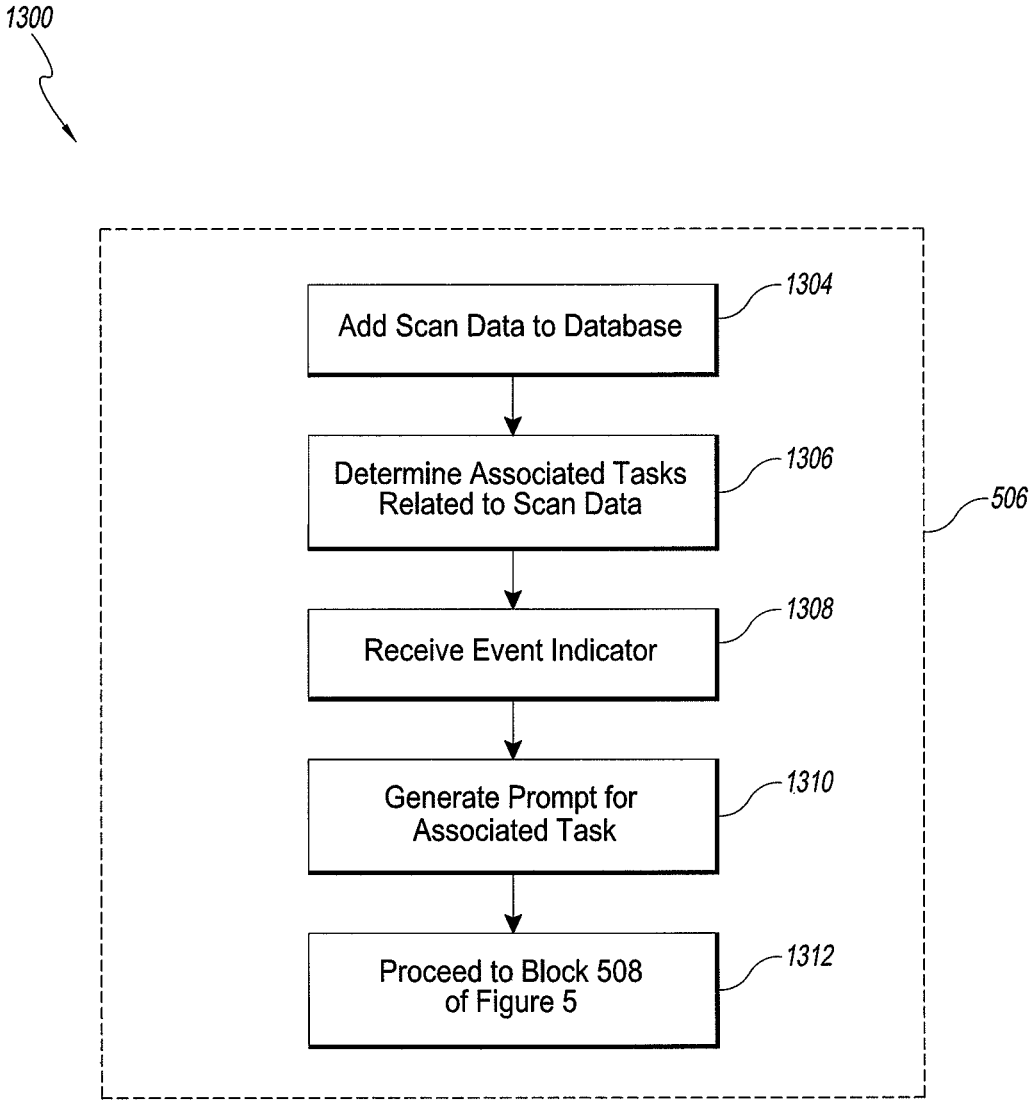
FIG. 13 is a flowchart illustrating one embodiment of a method for using a PASS system to track and complete tasks.

FIG. 13 is a flowchart illustrating a process 1300 for using a PASS system 300 to manage tasks associated with an item. As seen in FIG. 13, the process 1300 can be performed as a part of the process 500 for using the PASS computing system for item processing, and specifically, the process 1300 can be performed as a part of block 506, shown in FIG. 5.

The process 1300 begins at block 1304 and the PASS computing system 301 adds scan data to a database. In some embodiments, specifically, the central computing unit 302 can add scan data to a database by providing instructions to the memory 304 to update a database with information relating to the scan data.

The process 1300 then proceeds to block 1306 and the PASS computing system 301 determines whether there are any associated tasks related to the scan data. In some embodiments, this determination can comprise the central computing unit 302 querying the memory 304 for information associated with the scan data. In the event that there is no information associated with the scan data, the central computing unit 302 can determine that there are no associated tasks related to the scan data. In the event that there is information associated with the scan data, the central computing unit 302 can determine whether the information associated with the scan data relates to associated tasks. In the event that the information does not relate to associated tasks, the central computing unit 302 can determine that there are no associated tasks related to the scan data. In the event that the information associated with the scan data relates to associated tasks, then the central computing unit 302 can determine that there are associated tasks related to the scan data.

In some embodiments, these tasks can comprise a variety of actions that are related to the item including, for example, special services associated with an item such as, for example, receiving recipient signatures at the time of delivery of an item, and/or any other special service.

In some embodiments, these tasks can be performed at the occurrence of another event. Thus, in some embodiments, a recipient's signature can be received at the time that an item is delivered.

After associated tasks related to the scan data are determined, the process 1300 proceeds to block 1308 and the PASS computing system receives an event indicator. In some embodiments, for example, the event indicator can be the receipt of scan data associated with the item. In some embodiments, the event indicator can comprise the receipt of scanned data associated with an item and associated with the occurrence of a triggering event such as, for example, the delivery of the item. This event indicator can be received by the PASS computing system from one of the other modules of the PASS system 300 such as, for example, the processing module 310 and/or the PASS module 100.

After the event indicator is received, the process 1300 proceeds to block 1310 and the PASS computing system generates a prompt for the associated task. In some embodiments, the generation of a prompt for the associated task can comprise the central computing unit 302 querying the memory 304 for instructions related to the associated task. The central computing unit 302 can then execute these instructions and generate a prompt to remind the user of the PASS system 300 to perform the associated task.

After the prompt for the associated task is generated, the process 1300 moves to block 1312 and proceeds to block 508 of FIG. 5.

Figure 14:
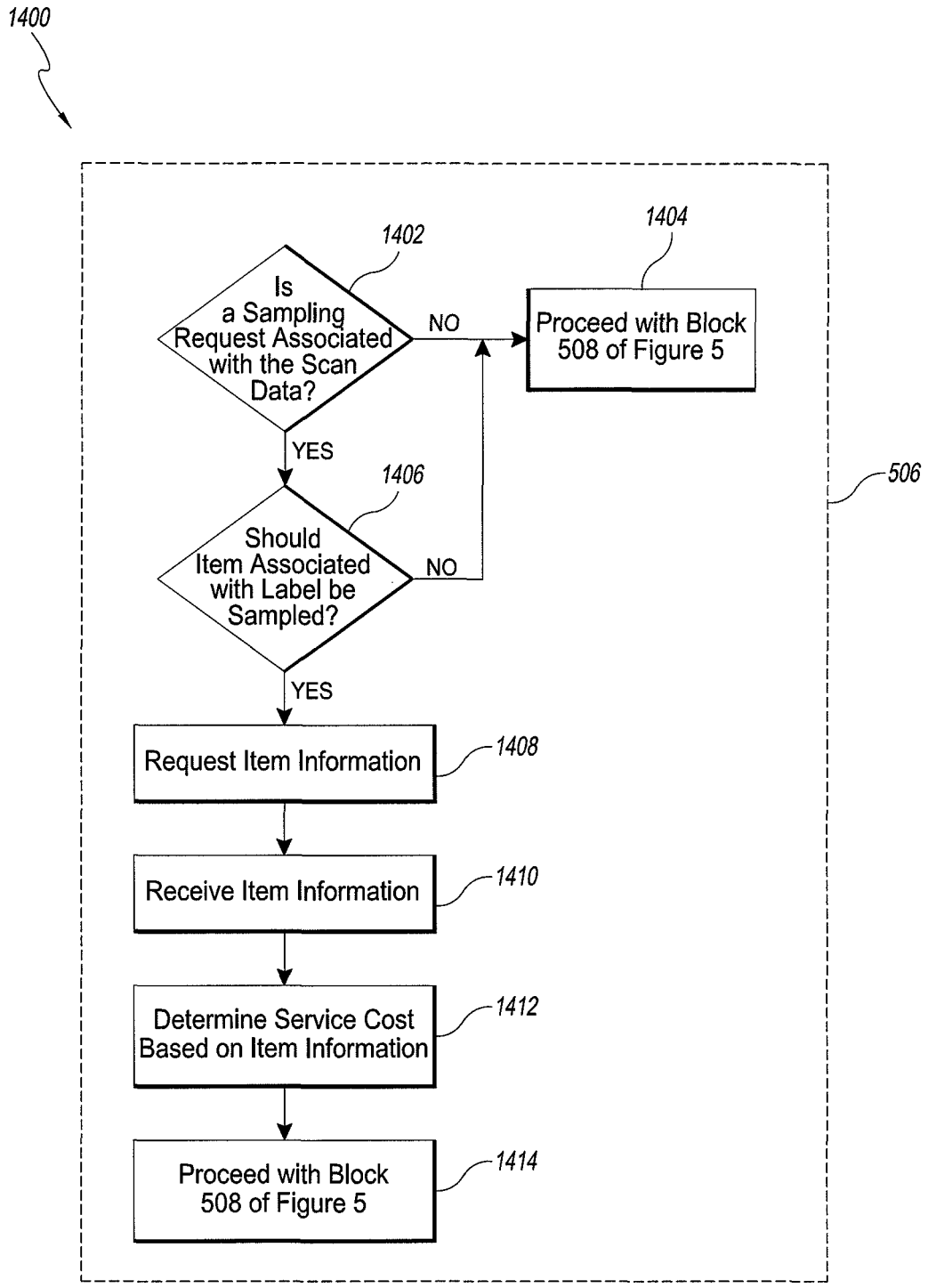
FIG. 14 is a flowchart illustrating one embodiment of a method for using a PASS system for sampling of items.

FIG. 14 is a flowchart illustrating a process 1400 for using a PASS system 300 for generating sampling-based information. As seen in FIG. 14, the process 1400 can be performed as a part of the process 500 for using the PASS computing system for item processing, and specifically, the process 1400 can be performed as a part of block 506, shown in FIG. 5.

The process 1400 can be performed by a variety of modules and/or components of the PASS system 300 including, for example, the PASS computing system 301. In some embodiments, the process 1400 can be configured to randomly sample items received within the PASS system 300 and use the random sampling to generate data that is representative of a larger group of items.

The process 1400 begins at decision state 1402 and the PASS computing system 301 determines if a sampling request is associated with the scan data. In some embodiments, this determination can comprise the central computing unit 302 querying the memory 304 to determine whether a sampling request has been stored in the memory. If no sampling request is associated with the scan data, then the process 1400 proceeds to block 1404 and proceeds with block 508 of FIG. 5.

Returning again to decision state 1402, if the sampling request is associated with the scan data, then the process 1400 moves to decision state 1406 and the PASS computing system 301 determines if the item associated with the label should be sampled. In some embodiments, this determination can be made by the central computing unit 302, and can be specifically made by the querying of a random number generator to determine whether or not the item associated with the label should be sampled. In some embodiments, certain outcomes of the random number generator can designate an item for sampling and/or for not sampling. In the event that an item is not designated for sampling, then the process 1400 moves to block 1404 and proceeds with block 508 of FIG. 5.

In the event that the item is designated for sampling, the process 1400 moves to block 1408 and the PASS computing system 301 requests item information. In some embodiments, for example, this request of item information can be made to, for example, the PASS module 100 and/or the processing module 310. In some embodiments, the requested item information can comprise, for example, physical parameters of the items such as, for example, the weight of the item, the dimensions of the item, the contents of the item, and/or any other desired information relating to the item.

After the item information is requested, the process 1400 moves to block 1410 and the PASS computing system 301 receives item information. In some embodiments, for example, the item information can be received from one of the modules of the PASS system 300 such as the PASS module 100 and/or the processing module 310. In some embodiments, the item information is received from the module to which the request for item information was made. Similar to above, the item information can comprise physical parameters of the item such as, for example, the weight of the item, the dimensions of the item, the contents of the item, and any other information relating to the item.

After the item information is received, the process 1400 moves to block 1412 and the PASS system 300 determines the service cost based on the item information. In some embodiments, the determination of the service cost based on item information can be made by the central computing unit 302, and in some embodiments, the determination of the service cost based on the item information can be made by the PASS module 100 and/or the processing module 310. In some embodiments, this determination is made by entering the physical parameters of the item, including the dimensions, the weight, the contents, the shipping origination point, and the intended destination into a cost formula to determine the cost for the requested services.

After the service cost based on the item information is determined, the process moves to block 1414 and proceeds with block 508 of FIG. 5.

In some embodiments, the determination of service costs based on item information can further comprise determining the batch of items from which the scanned data was taken. In some embodiments, and as briefly mentioned, the scanned data can relate to one of a batch of items. In some embodiments, the service costs associated with the item can be added with other randomly sampled and generated services costs to determine an average per piece service cost for the batch. This average per piece service cost for the batch can be used to then calculate the overall total cost for providing services to the batch of items.

A person of skill in the art will recognize that the above-outlined process 1400 to sample items in a batch to generate information with the PASS system 300 can comprise more or fewer steps than those illustrated above. A person of skill in the art will further recognize that the steps outlined above can be performed in the same or different order than specifically described herein.

Figure 15:
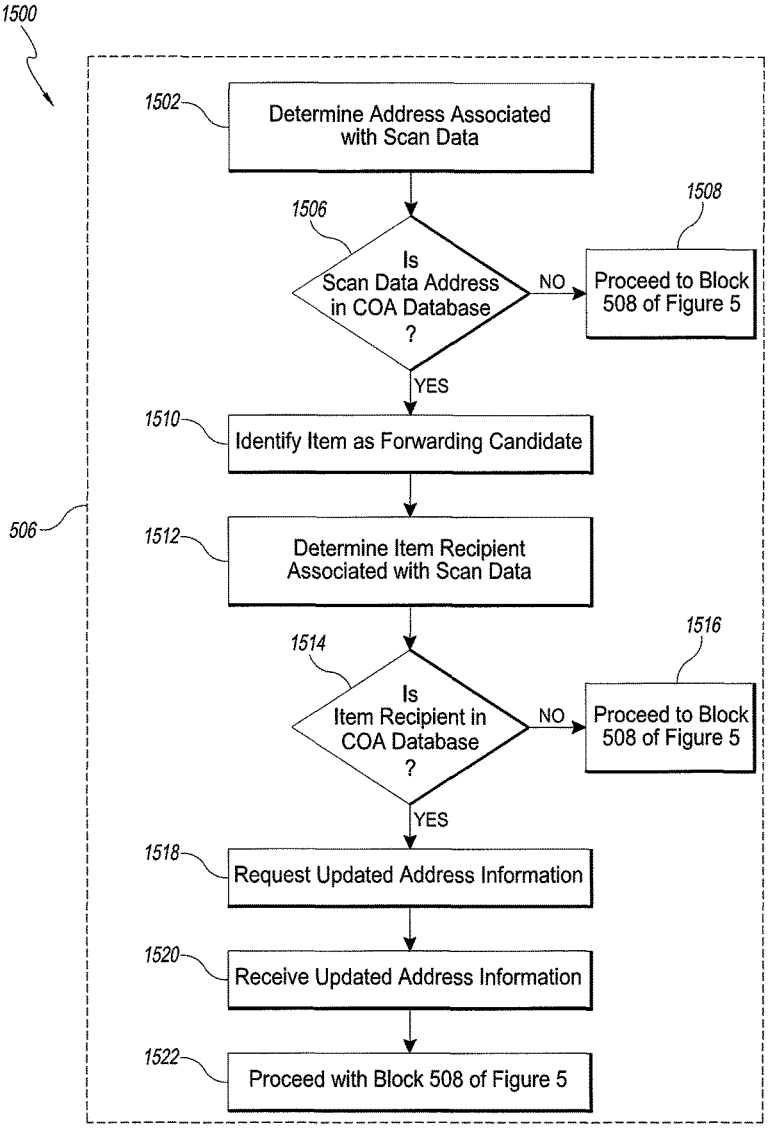
FIG. 15 is a flowchart illustrating one embodiment of a method for using a PASS system to redirect an item to a new location.

In some embodiments, the PASS system 300 can be used in connection with a change-of-address database to forward items to an intended recipient whose address has changed. FIG. 15 is a flowchart illustrating a process 1500 for using a PASS system 300 in connection with a change-of-address database to deliver an item to an updated address. As seen in FIG. 15, the process 1500 can be performed as a part of the process 500 for using the PASS computing system for item processing, and specifically, the process 1500 can be performed as a part of block 506, shown in FIG. 5.

The process 1500 can be performed by a variety of components and/or modules of the PASS system 300. In some embodiments, the process 1500 is performed by the PASS computing system 301.

The process 1500 begins at block 1502 and the PASS computing system 301 determines the address associated with the scan data. In some embodiments, this determination can include, for example, extracting address information embedded in the scan data and/or querying a database with the scan data to determine the address associated with the scan data. In some embodiments, this step can be performed by the central computing unit 302 which can query the memory 304 for address information associated with the scan data. In some embodiments, the PASS computing system 301 can query a database associated with other systems which can be located inside the PASS system 300, external to the PASS system 300, and/or controlled by a third party.

After the address associated with the scan data is determined, the process 1500 proceeds to decision state 1506 and the PASS computing system 301 determines if the scan data address is in the change-of-address database. In some embodiments, the change-of-address database can be located in the memory 304, can be located external to the PASS computing system 301, can be located external to the PASS system 300, and/or can be controlled by a third party. In some embodiments, the central computing unit 302 can query the appropriate database to determine if the address associated with the scan data is in the change-of-address database. If the address associated with the scan data is not in the change-of address database, then the process 1500 can move to block 1508 and proceed to block 508 of FIG. 5.

If the address associated with the scan data is in the change-of-address database, then the process 1500 can move to block 1510 and the PASS computing system 301 can identify the item as a forwarding candidate. In some embodiments, as multiple individuals and/or entities may share an address, the existence of an address in the change-of-address database may not be definitive in determining or not an item should be forwarded. Thus, in some embodiments, determining when an address associated with the scan data is in a change-of-address database, is sufficient to identify an item as a forwarding candidate, and not to definitively determine that an item should be forwarded.

After an item is identified as a forwarding candidate, the process 1500 moves to block 1512 and the PASS computing system 301 determines the item recipient associated with the scan data. In some embodiments, the item recipient information can be embedded in the scan data, in some embodiments, the item recipient information may not be associated in the scan data, but can be associated with the scan data in a separate database. Thus, in some embodiments, the recipient can be determined by retrieving information embedded in the scanned data, and in other embodiments, the item recipient can be determined by querying a database with information from the scan data to determine the item recipient associated with the scan data.

After the item recipient associated with the scan data is determined, the process 1500 moves to decision state 1514 and the PASS computing system 301 determines if the item recipient is in the change-of-address database. In some embodiments, this determination can include the central computing unit 302 querying the change-of-address database to determine whether or not the item recipient is indicated in the change-of-address database as someone whose address has changed. If the item recipient is not in the change-of address database, then the process 1500 moves to block 1516 and proceeds to block 508 of FIG. 5.

Returning again to decision state 1514, if the item recipient is in the change-of-address database, then the process 1500 moves to block 1518 and the PASS computing system 301 requests updated address information. In some embodiments, the request for updated address information can comprise the central computing unit 302 querying the change-of-address database for updated address information.

After the updated address information has been requested, the process 1500 proceeds to block 1520 and the PASS computing system 301 receives the updated address information. After the updated address information has been received, the process 1500 moves to block 1522 and proceeds with block 508 of FIG. 5.

A person of skill in the art will recognize that the process 1500 can include more or fewer steps than those outlined above. A person of skill in the art will further recognize that the above-outlined steps of process 1500 can be performed in the same order outlined above or in a different order.

In some embodiments, the PASS system 300 can be used to track employee information and/or employee work product. In some embodiments, the PASS system 300 can be used to track work product and/or employee information for a group of employees.

Figure 16:
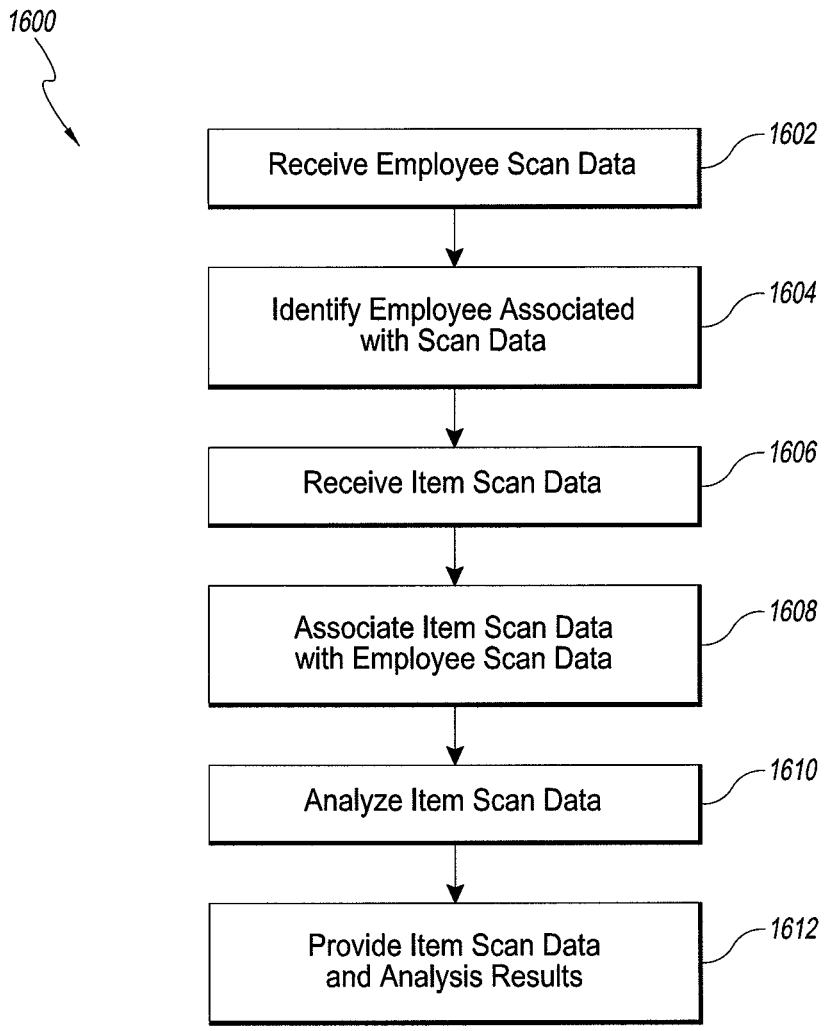
FIG. 16 is an illustrating one embodiment of a method for using a PASS system to increase employee productivity.

FIG. 16 is a flowchart illustrating one embodiment of a process 1600 for using the PASS system 300 to track data relating to an employee. In some embodiments, the process 1600 can be performed by the PASS system 300 and more specifically, by the PASS computing system 301.

The process 1600 begins at block 1602 and the PASS computing system 301 receives employee scan data. In some embodiments, before starting work, an employee can scan some identifying badge into the PASS system 300. In some embodiments, this scan can be made by the PASS module 100 and/or any other scanning unit within the PASS system.

After the employee scan data has been received, the process 1600 moves to block 1604 and the PASS computing system 301 identifies the employee associated with the scan data. In some embodiments, the identification of the employee associated with the scan data can be achieved by the central computing unit 302 querying the memory 304 for employee information. In some embodiments, the memory 304 can comprise a database listing employees and their associated scanned badge.

After the employee associated with the scanned data has been identified, the process 1600 moves to block 1606 and the PASS computing system 301 receives item scan data. In some embodiments, the PASS computing system 301 is able to distinguish whether the received item scan data is originating from the same source as the received employee scan data. In the event that the received item scan data is from the same source as the received employee scan data, then the process 1600 can move to block 1608 and the PASS computing system 301 can associate the item scan data with the employee scan data. In some embodiments, the association of the item scan data with the employee scan data can comprise the central computing unit 302 updating a database in the memory 304 with item scan data and an indication that the item scan data is associated with the employee scan data.

After the item scan data is associated with the employee scan data, the process 1600 moves to block 1610 and the PASS computing system 301 analyzes the item scan data. In some embodiments, this analysis can be performed by the central computing unit 302 and can comprise querying the memory for information relating to the employee scan data. In some embodiments, this analysis can include, for example, adding the entirety of items scanned associated with the employee scan data, determining the length of time that an employee was performing work associated with the PASS system 300, determining the number of item scans performed by the employee in a specified time, and/or any other information relating to the item scan data associated with the employee.

After the item scan data is analyzed, the process 1600 moves to block 1612 and the PASS computing system 301 provides item scan data and analysis results. In some embodiments, for example, the PASS computing system 301 can provide item scan data and analysis results to, for example, another module of the PASS system 300, such as the administration module 312. In some embodiments, this scan data and analysis results can then be used to determine workforce efficiency, employee efficiency, for scheduling purposes, and to determine the number of employees required to perform any designated task.

A person of skill in the art will recognize that the gathered item scan data and employee scan data can then be used to generate a wide range of data useful for evaluating employee productivity, facility productivity, task productivity, and a variety of other items. A person of skill in the art will further recognize that the process 1600 depicted in FIG. 16 can have more or fewer steps than those listed herein, and that the steps indicated in FIG. 16 can be performed in the same order or a different order.

Figure 17:
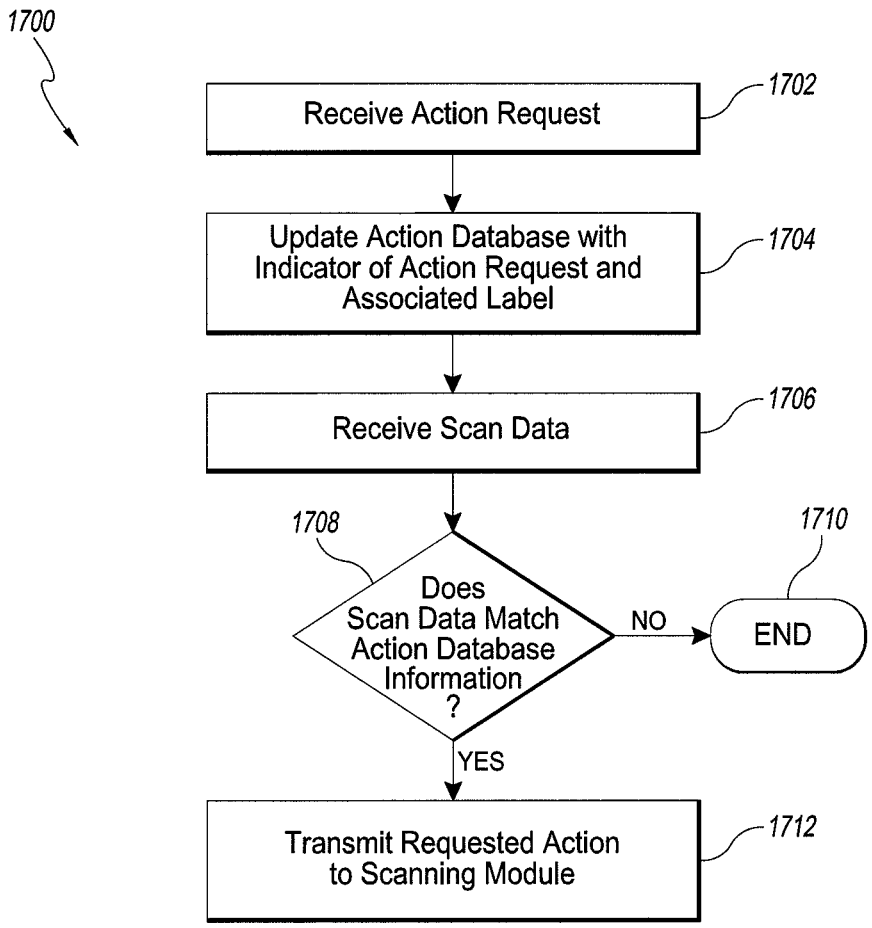
FIG. 17 is a flowchart illustrating one embodiment of a method for tracking and performing actions on an item.

In some embodiments, the PASS system 300 can be used to track and perform actions on an item. FIG. 17 depicts one embodiment of a process 1700 for tracking and performing actions on an item. Specifically, FIG. 17 depicts an embodiment of a process 1700 for using a PASS computing system 301 and a PASS system 300 to track and perform actions on an item. In some embodiments, these actions can include, for example, redirecting an item from one destination point to a new destination point, removing an item from circulation, testing and/or sampling an item, seizing an item, evaluating the contents of an item and/or the physical characteristics of an item, and/or performing an investigation relating to the item The process 1700 begins at block 1702 when the PASS computing system 301 receives an action request. In some embodiments, the action request can be received from another module of the PASS system 300 such as, for example, the administration module 312, the security module 314, the verification module 318, and/or any other module of the PASS system 300. In some embodiments, for example, the action request can comprise a request to seize an item, destroy an item, inspect an item, test an item, remove an item from circulation, redirect an item, and/or perform any other action on the item.

In some embodiments, the receipt of the action request can also include a receipt of an indication and/or identification of the label associated with the action request.

After the action request has been received, the process 1700 moves to block 1704 and the PASS computing system 301 updates the action database with an indicator of the action request and the associated label. In some embodiments, this update can be performed by the central computing unit 302 which can instruct the memory 304 to update a database with an indicator of the action request and the associated label.

After the action database has been updated with an indicator of the action request and the associated label, the process 1700 can proceed to block 1706 and the PASS computing system 301 can receive the scan data. In some embodiments, the scan data can be received from one of the modules of the PASS system 300 such as, for example, the PASS module 100 and/or the processing module 310.

After the scan data has been received, the process 1700 moves to decision state 1708 and the PASS computing system 301 determines if the scan data matches information in the action database. In some embodiments, this determination can be performed by the central computing unit 302, which can compare the scan data received from one of the modules of the PASS system 300 with the action database. In some embodiments, this comparison can comprise querying the memory 304 for information from the action database to determine if the scan data matches the action database.

If the PASS computing system 301 determines that the scan data does not match the data in the action database, then the process terminates at block 1710.

Returning again to decision state 1708, if the PASS computing system 301 determines that the scan data matches information in the action database, then the process 1700 moves to block 1712 and the PASS computing system 301 transmits the requested action information to the scanner module 108. In some embodiments, this transmission can be performed by the central computing unit 302 which can communicate with, for example, the processing module 310 and/or PASS module 100 to provide instructions to perform the requested action. In some embodiments, the process 1700 can then proceed to an additional step not shown in FIG. 17 in which the PASS computing system 301 receives confirmation that the requested action has been performed, and in some embodiments, the PASS computing system 301 can then update the action database to indicate that the requested action was completed.

A person of skill in the art will recognize that the process 1700 illustrated in FIG. 17 can comprise more or fewer steps than those specifically illustrated in FIG. 17. A person of skill in the art will further recognize that the steps of process 1700 can be performed in the same order as illustrated in FIG. 17 or in a different order.

A person skilled in the art will recognize that each of these sub-systems can be inter-connected and controllably connected using a variety of techniques and hardware and that the present disclosure is not limited to any specific method of connection or connection hardware.

The technology is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

As used herein, instructions refer to computer-implemented steps for processing information in the system. Instructions can be implemented by a processor which can comprise software, firmware or hardware and include any type of programmed step undertaken by components of the system.

A processor may be any conventional general purpose single- or multi-chip processor and/or microprocessor such as a Pentium® processor, a Pentium® Pro processor, a 8051 processor, a MIPS® processor, a Power PC® processor, or an Alpha® processor. In addition, the microprocessor may be any conventional special purpose microprocessor such as a digital signal processor or a graphics processor. The microprocessor typically has conventional address lines, conventional data lines, and one or more conventional control lines.

The system may be used in connection with various operating systems such as Linux®, UNIX® or Microsoft Windows®.

The system control may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python or Ruby.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for item processing in an item distribution system comprising:

a camera configured to capture an image of a label located on a second item being processed by item processing equipment in the item distribution system, the label including data located thereon;

a database comprising an indicator of a label that has been associated with a first item that is different than the second item;

a processor in communication with the camera, wherein the processor is configured to:

generate scan data from the captured image of the label;

compare information from the scan data to the indicator in the database to identify a match indicating fraud; and if a match is identified, then to cause the item processing equipment to do at least one of redirect the second item from a first path toward a first destination to a second path toward a second destination, remove the second item from circulation, test and/or sample the second item, seize the second item, or evaluate contents and/or physical characteristics of the second item;

wherein fraud is determined by any two or more of (a)-(i):

(a) payment discrepancies between paid-for services and provided services by verifying payment information and account holder, (b) altering the provided services for a received item based on difference between actual cost received for service and required payment, (c) redirecting an item based on the connection between the originated request of the sender and the entry of the request, (d) unapproved use of a user account after exceeding number of action threshold of submitted items with label information that does not match with scan item information, (e) label fraud by detecting use of duplicate labels, (f) label fraud by detecting use of invalid labels, (g) label fraud by detecting improper labeling, (h) label fraud by querying label database and scan database, or (i) payment fraud by related payment inputs and outputs of the matching account holder.

2. The system of claim 1, wherein the camera is configured to capture an image of the item when a label on the item is viewable by the camera within a defined three-dimensional space.

3. The system of claim 1, wherein the processor is further configured to communicate the scan data to a central computing unit configured to store information and instructions related to the item.

4. The system of claim 3, wherein the processor is further configured to receive instructions relating to a disposition location of the item from the central computing unit.

5. The system of claim 1, further comprising a cart and a boom, wherein the boom is connected to the cart at a first end and wherein a second end of the boom extends from the cart and the camera is located at the second end of the boom.

6. The system of claim 1, wherein the output comprises at least one of an audible or visual output.

7. The system of claim 6, wherein the visual output comprises a colored light.

8. The system of claim 1, wherein the scan data uniquely identifies the item.

9. The system of claim 1, wherein the label comprises information for determining item processing instructions.

10. The system of claim 9, wherein item processing instructions identify tasks relating to the item.

11. The system of claim 1 wherein the processor is further configured to:

determine a physical characteristic of the item;

determine if information from the scan data corresponds to the physical characteristic of the item; and provide instructions for further processing of the item based on whether the information from the scan data corresponds to the physical characteristic of the item.

12. The system of claim 1 wherein, if a match is not identified, the processor is further configured to:

identify an indicator of a label that is identified as having been scanned in a designated time frame;

determine if information from the scan data corresponds to the indicator of a label that is identified as having been scanned in a designated time frame; and provide instructions for further processing of the item based on whether information from the scan data corresponds to the indicator of a label that is identified as having been scanned in a designated time frame.

13. A system for item processing in an item distribution system comprising:

a hardware implemented scan module configured to capture item information from an item being processed by item processing equipment in the item distribution system, the item information comprising physical characteristics of the item and to capture label information from a label located on the item, the label information comprising physical characteristics of an item associated with the label, and to generate scan data relating to the item information and the label information;

a computing system comprising a processor; wherein the computing system is configured to:

receive the scan data;

determine a physical characteristic of the item based at least in part on the scan data relating to the item information;

determine if the determined physical characteristic of the item corresponds with the captured label information from the label located on the item; and if a correspondence is not determined, thus indicating fraud, then to cause the item processing equipment to do at least one of redirect the item from a first path toward a first destination to a second path toward a second destination, remove the item from circulation, test and/or sample the item, seize the item, or evaluate contents and/or physical characteristics of the item wherein fraud is determined by any two or more of (a)-(i):

(a) payment discrepancies between paid-for services and provided services by verifying payment information and account holder, (b) altering the provided services for a received item based on difference between actual cost received for service and required payment, (c) redirecting an item based on the connection between the originated request of the sender and the entry of the request, (d) unapproved use of a user account after exceeding number of action threshold of submitted items with label information that does not match with scan item information, (e) label fraud by detecting use of duplicate labels, (f) label fraud by detecting use of invalid labels, (g) label fraud by detecting improper labeling, (h) label fraud by querying label database and scan database, or (i) payment fraud by related payment inputs and outputs of the matching account holder.

14. The system of claim 13, wherein the computing system is further configured to update a first database with the scan data.

15. The system of claim 13, wherein the computing system comprises a second database and a third database.

16. The system of claim 15, wherein the second database includes an indicator of scan data that has been associated with more than one item.

17. The system of claim 16, wherein the third database includes an indicator of all of the scan images generated in a specified time frame.

18. The system of claim 16, wherein the third database includes an indicator of all of the scan images generated in a designated past time period.

19. The system of claim 13, wherein the item information comprises information for determining item processing instructions.

20. The system of claim 19, wherein item processing instructions identify tasks relating to the item.

21. The system of claim 13 wherein the computing system is further configured to:

identify an indicator of a label that is identified as having been scanned in a designated time frame;

determine if information from the scan data corresponds to the indicator of a label that is identified as having been scanned in a designated time frame; and provide instructions for further processing of the item based on whether information from the scan data corresponds to the indicator of a label that is identified as having been scanned in a designated time frame.

22. A method of item processing in an item distribution system comprising:

capturing, by an imaging device, an image of a label located on a second item being processed by item processing equipment in the item distribution system, the label including data located thereon;

generating, by a processor, scan data from the captured image of the label;

comparing information from the scan data to an indicator of a label, in a database, that has been associated with a first item that is different than the second item, to identify a match which indicates fraud; and if a match is identified, then causing the item processing equipment to do at least one of redirect the item from a first path toward a first destination to a second path toward a second destination, remove the item from circulation, test and/or sample the item, seize the item, or evaluate contents and/or physical characteristics of the item wherein fraud is determined by any two or more of (a)-(i):

(a) payment discrepancies between paid-for services and provided services by verifying payment information and account holder, (b) altering the provided services for a received item based on difference between actual cost received for service and required payment, (c) redirecting an item based on the connection between the originated request of the sender and the entry of the request, (d) unapproved use of a user account after exceeding number of action threshold of submitted items with label information that does not match with scan item information, (e) label fraud by detecting use of duplicate labels, (f) label fraud by detecting use of invalid labels, (g) label fraud by detecting improper labeling, (h) label fraud by querying label database and scan database, or (i) payment fraud by related payment inputs and outputs of the matching account holder.

23. The method of claim 22, further comprising:

detecting the presence of the item within a defined three-dimensional image; and triggering the capturing of the image in response to detecting the presence of the item.

24. The method of claim 22, further comprising updating a local database with the scan data.

25. The method of claim 24, wherein the local database is updated with an indicator of the captured image.

26. The method of claim 22, further comprising providing information relating to the captured image.

27. The method of claim 26, wherein the information comprises a representation of the captured image.

28. A method of item processing in an item distribution system comprising:

receiving information relating to a scan of a label associated with an item being processed by item processing equipment in the item distribution system;

comparing the received information to an indicator of a label in a database that is identified as having been scanned in a designated time frame; and if the received information corresponds to the indicator of the label identified as having been scanned in a designated time frame, indicating fraud, then using the item processing equipment to do at least one of redirect the item from a first path toward a first destination to a second path toward a second destination, remove the item from circulation, test and/or sample the item, seize the item, or evaluate contents and/or physical characteristics of the item wherein fraud is determined by any two or more of (a)-(i):

(a) payment discrepancies between paid-for services and provided services by verifying payment information and account holder, (b) altering the provided services for a received item based on difference between actual cost received for service and required payment, (c) redirecting an item based on the connection between the originated request of the sender and the entry of the request, (d) unapproved use of a user account after exceeding number of action threshold of submitted items with label information that does not match with scan item information, (e) label fraud by detecting use of duplicate labels, (f) label fraud by detecting use of invalid labels, (g) label fraud by detecting improper labeling, (h) label fraud by querying label database and scan database, or (i) payment fraud by related payment inputs and outputs of the matching account holder.

29. The method of claim 22, wherein the label comprises information for determining item processing instructions.

30. The method of claim 29, wherein item processing instructions identify tasks relating to the item.

31. The method of claim 22, further comprising:

determining a physical characteristic of the item;

determining if information from the scan data corresponds to the physical characteristic of the item; and providing instructions for further processing of the item based on whether the information from the scan data corresponds to the physical characteristic of the item.

32. The method of claim 22 wherein, if a match is not identified, the method further comprises:

identifying an indicator of a label that is identified as having been scanned in a designated time frame;

determining if information from the scan data corresponds to the indicator of a label that is identified as having been scanned in a designated time frame; and providing instructions for further processing of the item based on whether information from the scan data corresponds to the indicator of a label that is identified as having been scanned in a designated time frame.

33. A method of item processing in an item distribution system comprising:

capturing, using a hardware implemented scan module, item information from an item being processed by item processing equipment in the item distribution system, the item information comprising physical characteristics of the item;

capturing, using a hardware implemented scan module, label information from a label located on the item, the label information comprising physical characteristics of an item associated with the label;

determining if at least some of the captured item information comprising physical characteristics of the item corresponds to at least some of the captured label information comprising physical characteristic of an item associated with the label; and if it is determined that the at least some of the captured item information does not correspond to the captured label information, indicating fraud, then causing the item processing equipment to do at least one of redirect the item from a first path toward a first destination to a second path toward a second destination, remove the item from circulation, test and/or sample the item, seize the item, or evaluate contents and/or physical characteristics of the item wherein fraud is determined by any two or more of (a)-(i):

(a) payment discrepancies between paid-for services and provided services by verifying payment information and account holder, (b) altering the provided services for a received item based on difference between actual cost received for service and required payment, (c) redirecting an item based on the connection between the originated request of the sender and the entry of the request, (d) unapproved use of a user account after exceeding number of action threshold of submitted items with label information that does not match with scan item information, (e) label fraud by detecting use of duplicate labels, (f) label fraud by detecting use of invalid labels, (g) label fraud by detecting improper labeling, (h) label fraud by querying label database and scan database, or (i) payment fraud by related payment inputs and outputs of the matching account holder.

34. The method of claim 33, further comprising:

comparing the captured label information to a first database comprising an indicator of a label that has been associated with a second item that is different than the item being processed by the processing equipment; and if the captured label information matches the indicator in the first database, then causing the item processing equipment to do at least one of redirect the item from a first path toward a first destination to a second path toward a second destination, remove the item from circulation, test and/or sample the item, seize the item, or evaluate contents and/or physical characteristics of the item.

35. The method of claim 33, further comprising extracting information associated with the label from the captured label information.

36. The method of claim 35, further comprising querying a database with the extracted information associated with the label for information relating to the requested service.

37. The method of claim 33, further comprising determining a payer.

38. The method of claim 37, further comprising:

determining if the sender of the item is ascertainable; and if the sender is ascertainable, indicating that the sender is the payer.

39. The method of claim 38, further comprising:

determining if the intended recipient is ascertainable if the sender is not ascertainable; and indicating that the intended recipient is the payer if the intended recipient is ascertainable.

40. The method of claim 22, further comprising:

detecting the presence of an item within a defined three-dimensional image; and triggering the capturing of the image in response to detecting the presence of the item.

* * * * *